US010811205B2

(12) United States Patent
Hayashida et al.

(10) Patent No.: US 10,811,205 B2
(45) Date of Patent: Oct. 20, 2020

(54) RELAY

(71) Applicant: OMRON CORPORATION, Kyoto-shi, Kyoto (JP)

(72) Inventors: Kaori Hayashida, Yamaga (JP); Yuji Kozai, Kumamoto (JP)

(73) Assignee: OMRON CORPORATION, Kyoto-shi (JP)

( * ) Notice: Subject to any disclaimer, the term of this patent is extended or adjusted under 35 U.S.C. 154(b) by 75 days.

(21) Appl. No.: 15/754,056

(22) PCT Filed: Oct. 3, 2016

(86) PCT No.: PCT/JP2016/079237
§ 371 (c)(1),
(2) Date: Feb. 21, 2018

(87) PCT Pub. No.: WO2017/073240
PCT Pub. Date: May 4, 2017

(65) Prior Publication Data

US 2018/0240631 A1 Aug. 23, 2018

(30) Foreign Application Priority Data

Oct. 29, 2015 (JP) ..... 2015-213088

(51) Int. Cl.
*H01H 50/54* (2006.01)
*H01H 50/56* (2006.01)
(Continued)

(52) U.S. Cl.
CPC ..... *H01H 50/56* (2013.01); *H01H 1/54* (2013.01); *H01H 9/38* (2013.01); *H01H 50/18* (2013.01);
(Continued)

(58) Field of Classification Search
CPC ..... H01H 50/18; H01H 50/56; H01H 50/58; H01H 50/541; H01H 1/50; H01H 1/54; H01H 1/64; H01H 9/38; H01H 2001/545
(Continued)

(56) References Cited

U.S. PATENT DOCUMENTS 4,328,476 A 5/1982 Bernier
4,551,698 A 11/1985 Aidn
(Continued)

FOREIGN PATENT DOCUMENTS

CN 102723241 A 10/2012
CN 203839295 U 9/2014
(Continued)

OTHER PUBLICATIONS

German Office Action dated Oct. 23, 2019 in a related German patent application.
(Continued)

*Primary Examiner* — Shawki S Ismail
*Assistant Examiner* — Lisa N Homza
(74) *Attorney, Agent, or Firm* — Metroplex IP Law Group, PLLC

(57) ABSTRACT

The link member is capable of pressing the contact piece. The link member includes a first pressing portion and a second pressing portion. The first pressing portion is configured to press the first divided piece, and extends in a widthwise direction of the contact piece. The second pressing portion is configured to press the second divided piece, and extends in a lengthwise direction.

16 Claims, 21 Drawing Sheets

(51) Int. Cl.

| | |
|---|---|
| ***H01H 50/64*** | (2006.01) |
| ***H01H 50/58*** | (2006.01) |
| ***H01H 51/22*** | (2006.01) |
| ***H01H 1/54*** | (2006.01) |
| ***H01H 9/38*** | (2006.01) |
| ***H01H 50/18*** | (2006.01) |

(52) U.S. Cl.
CPC ..... *H01H 50/58* (2013.01); *H01H 50/64* (2013.01); *H01H 50/641* (2013.01); *H01H 51/2227* (2013.01); *H01H 2001/545* (2013.01)

(58) Field of Classification Search
USPC ..... 335/2, 78–86, 131–136
See application file for complete search history.

(56) References Cited

U.S. PATENT DOCUMENTS

| | | | | |
|---|---|---|---|---|
| 4,571,566 | A | 2/1986 | Saur | |
| 4,703,293 | A | 10/1987 | Ono et al. | |
| 4,731,597 | A | 3/1988 | Hinrichs | |
| 4,743,877 | A * | 5/1988 | Oberndorfer | H01H 50/58 335/128 |
| 5,117,209 | A | 5/1992 | Sato | |
| 5,357,230 | A | 10/1994 | Mikawa | |
| 5,617,066 | A | 4/1997 | Dittmann et al. | |
| 5,910,759 | A * | 6/1999 | Passow | H01H 51/2227 335/78 |
| 6,020,801 | A * | 2/2000 | Passow | H01H 71/68 335/113 |
| 6,046,661 | A * | 4/2000 | Reger | H01H 50/56 335/185 |
| 6,292,075 | B1 * | 9/2001 | Connell | H01H 50/20 335/132 |
| 6,320,485 | B1 * | 11/2001 | Gruner | H01H 50/546 335/132 |
| 6,426,689 | B1 * | 7/2002 | Nakagawa | H01H 51/2272 335/78 |
| 6,661,319 | B2 * | 12/2003 | Schmelz | H01H 1/26 335/128 |
| 6,788,176 | B2 * | 9/2004 | Schmelz | H01H 51/2227 335/124 |
| 6,911,884 | B2 | 6/2005 | Uotome et al. | |
| 6,924,719 | B2 | 8/2005 | Saruwatari et al. | |
| 6,940,375 | B2 * | 9/2005 | Sanada | H01H 50/56 335/129 |
| 6,949,997 | B2 * | 9/2005 | Bergh | H01H 50/326 335/78 |
| 7,659,800 | B2 | 2/2010 | Gruner et al. | |
| 7,859,370 | B2 | 12/2010 | Shirakawa | |
| 7,982,562 | B2 * | 7/2011 | Yang | H01H 1/28 335/129 |
| 8,330,564 | B2 * | 12/2012 | Miller | H01H 1/54 335/128 |
| 9,548,172 | B2 | 1/2017 | Hauck et al. | |
| 9,548,173 | B2 * | 1/2017 | Connell | H01H 50/16 |
| 9,741,518 | B2 * | 8/2017 | Choi | H01H 50/36 |
| 9,899,174 | B2 * | 2/2018 | Zhang | H01H 50/58 |
| 10,541,097 | B2 * | 1/2020 | Hoffmann | H01H 50/047 |
| 2002/0135446 | A1 | 9/2002 | Takano et al. | |
| 2009/0033446 | A1 * | 2/2009 | Gruner | H01H 1/26 335/129 |
| 2014/0225688 | A1 | 8/2014 | Masui et al. | |
| 2015/0002248 | A1 * | 1/2015 | Iwamoto | H01H 3/001 335/192 |
| 2015/0042423 | A1 | 2/2015 | Hoffmann et al. | |
| 2015/0325398 | A1 | 11/2015 | Nakahara et al. | |
| 2016/0012997 | A1 | 1/2016 | Neuhaus et al. | |
| 2018/0240631 | A1 | 8/2018 | Hayashida et al. | |
| 2018/0269018 | A1 | 9/2018 | Shimoda et al. | |
| 2019/0013172 | A1 | 1/2019 | Hayashida et al. | |

FOREIGN PATENT DOCUMENTS

| | | | |
|---|---|---|---|
| CN | 104282493 | A | 1/2015 |
| CN | 104508787 | A | 4/2015 |
| CN | 204464182 | U | 7/2015 |
| CN | 204596721 | U | 8/2015 |
| CN | 104969325 | A | 10/2015 |
| EP | 1511052 | B1 | 11/2007 |
| EP | 2782110 | A1 | 9/2014 |
| EP | 2822011 | A1 | 1/2015 |
| EP | 2394284 | B1 | 4/2016 |
| EP | 3021342 | A1 | 5/2016 |
| EP | 3089190 | A1 | 11/2016 |
| EP | 3113204 | A1 | 1/2017 |
| JP | S32-7501 | Y1 | 7/1957 |
| JP | S56-100819 | U | 8/1981 |
| JP | S58-71918 | U | 5/1983 |
| JP | S58-182321 | U | 12/1983 |
| JP | S59-111219 | A | 6/1984 |
| JP | S59-126443 | U | 8/1984 |
| JP | 2005-183097 | A | 7/2005 |
| JP | 2009-224150 | A | 10/2009 |
| JP | 2012-517092 | A | 7/2012 |
| JP | 2012-212667 | A | 11/2012 |
| JP | 2013-41764 | A | 2/2013 |
| JP | 5741679 | B1 | 7/2015 |
| JP | 2015-159025 | A | 9/2015 |
| JP | 2015-216053 | A | 12/2015 |
| WO | 2015/005082 | A1 | 1/2015 |
| WO | 2015/005313 | A1 | 1/2015 |
| WO | 2015/045738 | A1 | 4/2015 |
| WO | 2015/098171 | A1 | 7/2015 |
| WO | 2015/125319 | A1 | 8/2015 |

OTHER PUBLICATIONS

Chinese Office Action (CNOA) dated Sep. 29, 2018 in a related Chinese patent application.
Indian Office Action dated Jan. 29, 2020 in a related Indian patent application.
Indian Office Action dated Dec. 9, 2019 in a related Indian patent application.
Chinese Office Action (CNOA) dated Jun. 11, 2019 in a related Chinese patent application.
Chinese Office Action (CNOA) dated Nov. 19, 2018 in a counterpart Chinese patent application.
Chinese Office Action (CNOA) dated Dec. 5, 2018 in a related Chinese patent application.
English translation of the International Search Report of PCT/JP2016/079237 dated Nov. 22, 2016.
English translation of the Written Opinion of PCT/JP2016/079237 dated Nov. 22, 2016.
English translation of the International Search Report of PCT/JP2016/079269 dated Nov. 22, 2016.
English translation of the Written Opinion of PCT/JP2016/079269 dated Nov. 22, 2016.
English translation of the International Search Report of PCT/JP2016/079256 dated Nov. 8, 2016.
English translation of the Written Opinion of PCT/JP2016/079256 dated Nov. 8, 2016.
U.S. Office Action dated Mar. 5, 2020 in a related U.S. Appl. No. 15/754,172.

* cited by examiner

RELAY

TECHNICAL FIELD

The present invention relates to a relay.

BACKGROUND ART

There is known a relay which includes a plurality of movable contacts and a plurality of fixed contacts. For example, a contact piece of a relay disclosed in Patent Document 1 includes a first divided piece and a second divided piece. An open/close movable contact is attached to the first divided piece, while an energization movable contact is attached to the second divided piece. An open/close fixed contact and an energization fixed contact are attached to a fixed contact terminal.

According to the relay as described above, contacts are opened or closed by press of a card against the contact piece. The card includes a slit extending in a widthwise direction of the contact piece. A leading end of the first divided piece and a leading end of the second divided piece are disposed inside the slit.

The leading end of the first divided piece and the leading end of the second divided piece are pressed in a direction toward the fixed contact terminal by one edge of the slit of the card in accordance with movement of the card in a direction toward the fixed contact terminal. The movable contacts therefore move toward the fixed contacts and come into contact with the fixed contacts. On the other hand, the leading end of the first divided piece and the leading end of the second divided piece are pressed in a direction away from the fixed contact terminal by the other edge of the slit of the card in accordance with movement of the card in a direction away from the fixed contact terminal. The movable contacts therefore separate from the fixed contacts.

PRIOR ART DOCUMENT

Patent Document

Patent Document 1: Japanese Patent No. 5741679

SUMMARY OF THE INVENTION

Problems to be Solved by the Invention

According to the relay including the plurality of movable contacts and the plurality of fixed contacts, appropriate values of contact parameters, such as contact force of contacts and separation force of contacts, differ depending on respective contacts. For example, in the relay disclosed in Patent Document 1, the open/close movable contact comes into contact with the open/close fixed contact before the energization movable contact contacts the energization fixed contact. In this case, the open/close movable contact and the open/close fixed contact achieve opening and closing of an electric load, while the energization movable contact and the energization fixed contact only achieve energization. Accordingly, no arc is produced between the energization movable contact and the energization fixed contact even when an arc is produced between the open/close movable contact and the open/close fixed contact.

An arc produced between contacts may cause welding of the contacts. It is therefore preferable to increase the separation force acting on the open/close movable contact so as to separate the open/close movable contact from the open/close fixed contact at the time of welding. According to the relay as described above, however, appropriate contact parameters are difficult to set for each contact.

An object of the present invention is to provide a relay capable of easily setting contact parameters for each contact of a plurality of movable contacts.

Means for Solving the Problem

A relay according to an aspect of the present invention includes a movable contact terminal, a contact piece, a first movable contact, a second movable contact, a fixed contact terminal, a first fixed contact, a second fixed contact, and a link member. The contact piece is attached to the movable contact terminal. The contact piece includes a first divided piece and a second divided piece. The first divided piece and the second divided piece extend in a lengthwise direction and divided from each other. The first movable contact is attached to the first divided piece. The second movable contact is attached to the second divided piece. The fixed contact terminal is disposed at a position facing the contact piece. The first fixed contact is attached to the fixed contact terminal, and disposed at a position facing the first movable contact. The second fixed contact is attached to the fixed contact terminal, and disposed at a position facing the second movable contact. The link member is capable of pressing the contact piece.

The link member includes a first pressing portion and a second pressing portion. The first pressing portion is configured to press the first divided piece, and extends in a widthwise direction of the contact piece. The second pressing portion is configured to press the second divided piece, and extends in a lengthwise direction.

In the relay according to the aspect, the first pressing portion and the second pressing portion extend in different directions. In this case, the position or size of a portion of the first divided piece pressed by the first pressing portion, and the position or size of a portion of the second divided piece pressed by the second pressing portion are easily adjustable by freely setting the dimensions and positions of the first pressing portion and the second pressing portion. Accordingly, contact parameters can be easily set for each of the first movable contact and the second movable contact.

The link member may include a third pressing portion and a fourth pressing portion. The third pressing portion may be configured to press the first divided piece, and extend in the widthwise direction of the contact piece. The fourth pressing portion may be configured to press the second divided piece, and extend in the lengthwise direction. The first pressing portion may press the first divided piece in a direction away from the fixed contact terminal. The second pressing portion may press the second divided piece in a direction away from the fixed contact terminal. The third pressing portion may press the first divided piece toward the fixed contact terminal. The fourth pressing portion may press the second divided piece toward the fixed contact terminal.

In this case, the separation force of the first movable contact is easily set by adjusting the dimension and position of the first pressing portion. The separation force of the second movable contact is easily set by adjusting the dimension and position of the second pressing portion. The contact force of the first movable contact is easily set by adjusting the dimension and position of the third pressing portion. The contact force of the second movable contact is easily set by adjusting the dimension and position of the fourth pressing portion.

A length of the first pressing portion in the widthwise direction of the contact piece may be different from a length of the third pressing portion in the widthwise direction of the contact piece. In this case, the first pressing portion and the third pressing portion can press different positions of the first divided piece.

The first pressing portion is shorter than the third pressing portion in the widthwise direction of the contact piece. In this case, the first pressing portion and the third pressing portion can press different positions of the first divided piece.

The first divided piece may include a first contact portion pressed by the first pressing portion. The first contact portion may be disposed at a position away from the first movable contact in the widthwise direction. In this case, a long distance can be secured between the first movable contact and the portion of the first divided piece pressed by the first pressing portion. Accordingly, the separation force of the first movable contact can be increased.

The first divided piece may include a third contact portion pressed by the third pressing portion. At least a part of the third contact portion may be located closer to the first movable contact than the first contact portion in the widthwise direction. In this case, the third contact portion is allowed to press a position close to the first movable contact at the time of contact between the first movable contact and the first fixed contact. Accordingly, contact stability between the first movable contact and the first fixed contact can be improved.

A length of the second pressing portion in the lengthwise direction of the contact piece may be different from a length of the fourth pressing portion in the lengthwise direction of the contact piece. In this case, the second pressing portion and the fourth pressing portion can press different positions of the second divided piece.

The second divided piece may include a second contact portion pressed by the second pressing portion. The first contact portion may be located on a leading end side of the contact piece with respect to the second contact portion. In this case, the first pressing portion presses the first contact portion, which can lead to large displacement of the first movable contact. Accordingly, the separation force of the first movable contact can be increased.

The second divided piece may include a fourth contact portion pressed by the fourth pressing portion. The third contact portion may be located on a leading end side of the contact piece with respect to the fourth contact portion. In this case, the third pressing portion presses the third contact portion, which can lead to large displacement of the first movable contact. Accordingly, the contact force of the first movable contact can be increased.

The link member may include a junction and a first projection. The junction may extend from the third pressing portion in a direction toward the fixed contact terminal from the contact piece. The first projection may project in the widthwise direction from the junction. The first contact portion may be provided on the first projection. In this case, the dimension of the first contact portion can be easily set by adjusting a projection length of the first projection.

The link member may include a first recess formed by the junction, the first projection, and the third pressing portion. A part of the first divided piece may be disposed inside the first recess. This configuration facilitates attachment of the link member to the relay, compared with a configuration where the link member is provided with a hole through which the first divided piece is inserted.

The link member may further include a second projection. The second projection may project in the lengthwise direction from the junction. The second contact portion may be provided on the second projection. In this case, the dimension of the second contact portion can be easily set by adjusting a projection length of the second projection.

The link member may further include a third projection. The third projection may project in the lengthwise direction from the junction. The fourth contact portion may be provided on the third projection. In this case, a dimension of the fourth contact portion can be easily set by adjusting a projection length of the third projection.

The link member may include a second recess formed by the junction, the second projection, and the third projection. A part of the second divided piece may be disposed inside the second recess. This configuration facilitates attachment of the link member to the relay, compared with a configuration where the link member is provided with a hole through which the second divided piece is inserted.

A leading end of the first divided piece may be located on a leading end side of the contact piece with respect to a leading end of the second divided piece. At least a part of the link member may be located between the leading end of the first divided piece and the leading end of the second divided piece in the lengthwise direction. In this case, the link member is allowed to press the leading end of the first divided piece and the leading end of the second divided piece. In addition, the size of the relay can be reduced.

The link member may be disposed in a range of the width of the contact piece. In this case, the size of the relay can be reduced.

A width of the second divided piece may be smaller than a width of the first divided piece. The second divided piece may include a rib provided at a widthwise edge of the second divided piece and extending in the lengthwise direction. In this case, the rib increases rigidity of the second divided piece.

Effect of the Invention

According to the present invention, contact parameters can be easily set for each contact of a plurality of movable contacts.

MODE FOR CARRYING OUT THE INVENTION

Figure 1:
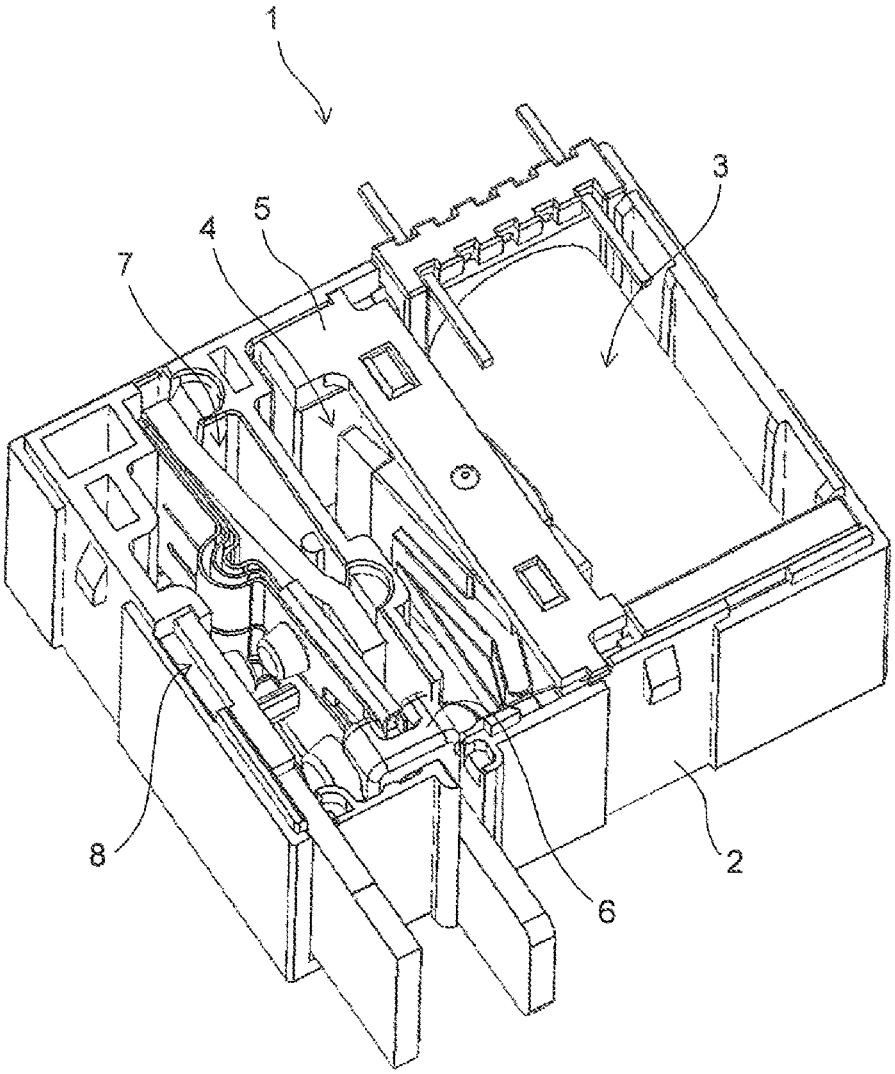
FIG. 1 is a perspective view of a relay according to an embodiment.
Figure 2:
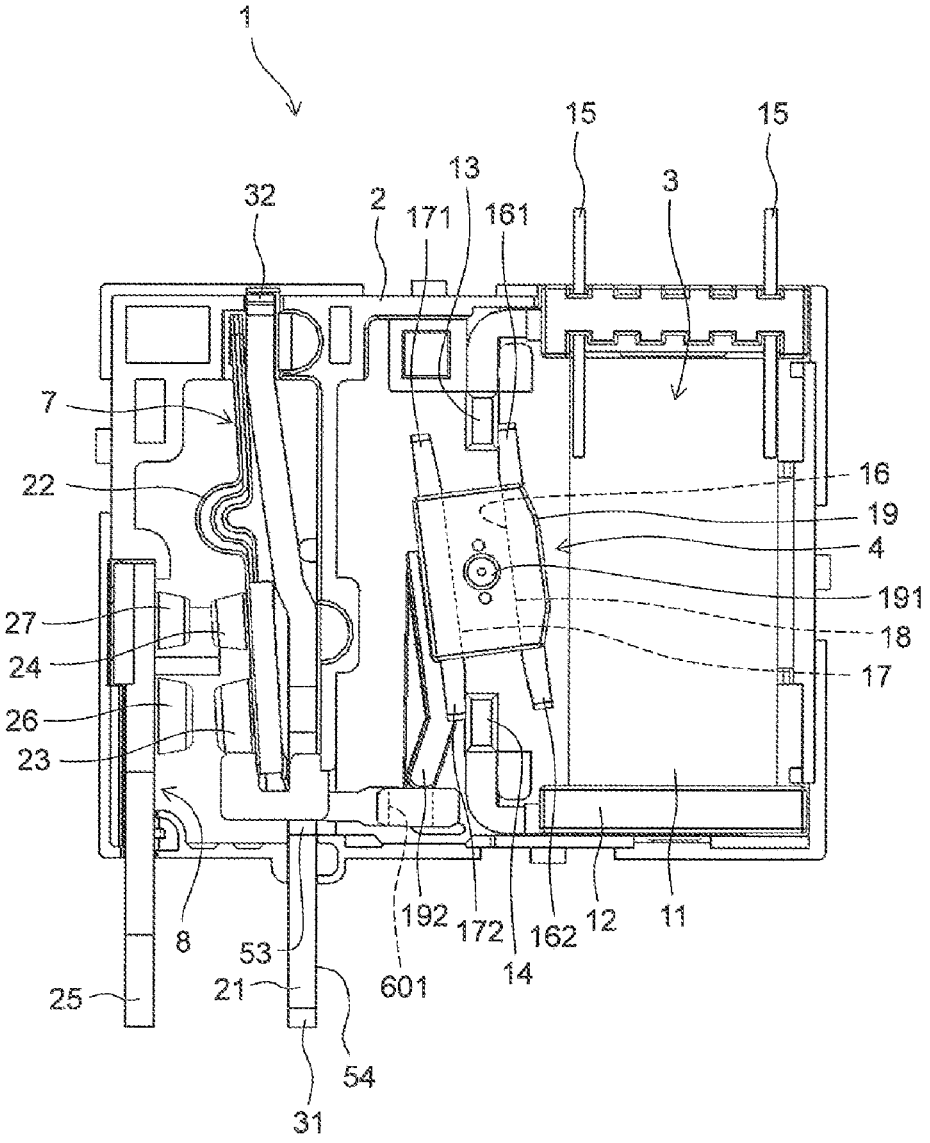
FIG. 2 is a plan view of the relay in a reset state.
Figure 3:
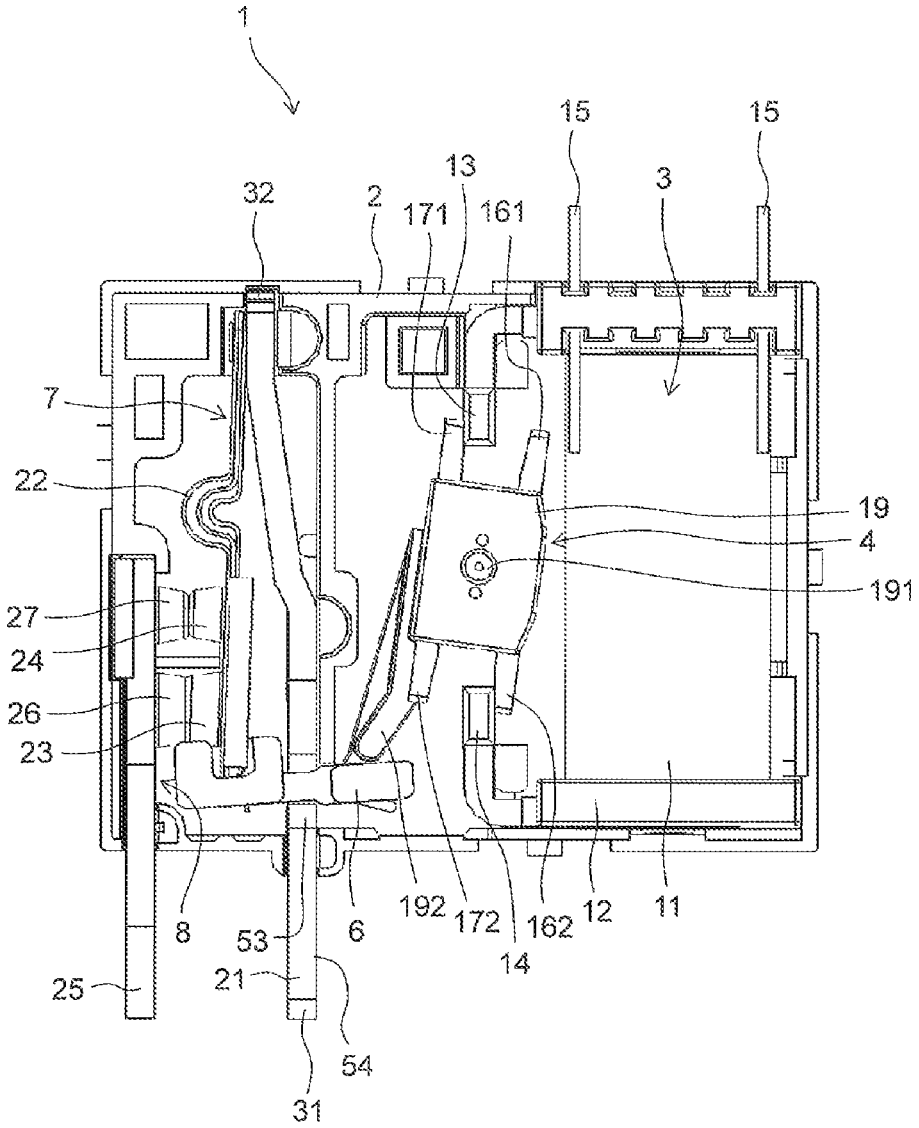
FIG. 3 is a plan view of the relay in a set state.

A relay according to an embodiment is hereinafter described with reference to the drawings. FIG. 1 is a perspective view of a relay 1 according to the embodiment. FIG. 2 is a plan view of the relay 1 in a reset state. FIG. 3 is a plan view of the relay 1 in a set state. The relay 1 includes a base 2, a driving unit 3, a movable unit 4, a support member 5, a link member 6, a contact piece unit 7, and a fixed contact unit 8. The support member 5 is not shown in FIGS. 2 and 3.

The base 2 houses the driving unit 3, the movable unit 4, the link member 6, the contact piece unit 7, and the fixed contact unit 8. A not-shown cover member is attached to the base 2.

The driving unit 3 drives the movable unit 4. The driving unit 3 generates electromagnetic force for rotating the movable unit 4. As illustrated in FIG. 2, the driving unit 3 includes a coil 11, a spool 12, a first yoke 13, and a second yoke 14. The coil 11 is wound around the spool 12. A coil terminal 15 is attached to the coil 11 such that the coil 11 can be energized via the coil terminal 15. A not-shown iron core is inserted into the spool 12. The first yoke 13 is connected with one end of the iron core, while the second yoke 14 is connected with the other end of the iron core.

The movable unit 4 is rotatably supported relative to the base 2. The movable unit 4 is disposed between the first yoke 13 and the second yoke 14. The movable unit 4 includes a first armature 16, a second armature 17, a permanent magnet 18, and a movable body 19. The first armature 16, the second armature 17, and the permanent magnet 18 are attached to the movable body 19. The movable body 19 is rotatably supported on the base 2 around a rotation shaft 191. The movable body 19 includes an arm 192. The arm 192 extends toward the link member 6.

The first armature 16 includes a first end 161 and a second end 162. The second armature 17 includes a third end 171 and a fourth end 172. The first end 161 and the third end 171 project in the same direction from the movable body 19. The second end 162 and the fourth end 172 project in the direction opposite to the projection direction of the first end 161 and the third end 171 from the movable body 19.

The link member 6 connects the movable body 19 and the contact piece unit 7. The link member 6 is so disposed as to cross a movable contact terminal 21 of the contact piece unit 7 described below in plan view. One end of the link member 6 is connected with the movable body 19. The other end of the link member 6 is connected with the contact piece unit 7. More specifically, the link member 6 includes a connection hole 601. A leading end of the arm 192 of the movable body 19 is disposed in the connection hole 601. This configuration latches the arm 192 to the link member 6 during driving of the link member 6 by the movable body 19. The link member 6 will be detailed below.

The contact piece unit 7 includes a movable contact terminal 21, a contact piece 22, and movable contacts 23 and 24. The contact piece 22 is connected with the movable contact terminal 21. The contact piece 22 is disposed at a position facing the movable contact terminal 21. The link member 6 described above is capable of pressing the contact piece 22. The movable contacts 23 and 24 are attached to the contact piece 22.

The fixed contact unit 8 includes a fixed contact terminal 25 and fixed contacts 26 and 27. The fixed contact terminal 25 is disposed at a position facing the contact piece 22. The fixed contacts 26 and 27 are attached to the fixed contact terminal 25. The fixed contacts 26 and 27 are disposed at positions facing the movable contacts 23 and 24, respectively.

Next, an operation of the relay 1 is described. In the reset state illustrated in FIG. 2, the first end 161 of the first armature 16 contacts the first yoke 13, while the second end 162 separates from the second yoke 14. The fourth end 172 of the second armature 17 contacts the second yoke 14, while the third end 171 separates from the first yoke 13. The movable contacts 23 and 24 separate from the fixed contacts 26 and 27, respectively.

When the coil 11 is energized in a predetermined direction, electromagnetic force is generated to rotate the movable unit 4 in a predetermined forward direction (clockwise in FIG. 2). The movable unit 4 therefore rotates in the forward direction. The link member 6 moves in the left direction in FIG. 2 in accordance with rotation of the movable unit 4 in the forward direction. In this case, a leading end of the contact piece 22 moves in the left direction in FIG. 2, and accordingly, the movable contacts 23 and 24 move toward the fixed contacts 26 and 27. The movable contacts 23 and 24 therefore come into contact with the fixed contacts 26 and 27. As a result, the reset state of the relay 1 illustrated in FIG. 2 is switched to the set state illustrated in FIG. 3.

In the set state, the first end 161 of the first armature 16 separates from the first yoke 13, while the second end 162 contacts the second yoke 14 as illustrated in FIG. 3. In addition, the fourth end 172 of the second armature 17 separates from the second yoke 14, while the third end 171 contacts the first yoke 13. The set state is maintained by magnetic force of the permanent magnet 18 even at a stop of energization of the coil 11 in this state.

When the coil 11 is subsequently energized in the direction opposite to the foregoing predetermined direction, electromagnetic force is generated to rotate the movable unit 4 in the direction opposite to the foregoing forward direction (anticlockwise in FIG. 3). As a result, the movable unit 4 rotates in the opposite direction. The link member 6 moves in the right direction in FIG. 3 in accordance with the rotation of the movable unit 4 in the opposite direction. In this case, the leading end of the contact piece unit 7 moves in the right direction in FIG. 3, and accordingly, the movable contacts 23 and 24 move away from the fixed contacts 26 and 27, respectively. The movable contacts 23 and 24 therefore separate from the fixed contacts 26 and 27, respectively. As a result, the set state of the relay 1 illustrated in FIG. 3 is switched to the reset state illustrated in FIG. 2. The reset state is maintained by magnetic force of the permanent magnet 18 even at a stop of energization of the coil 11 in this state.

Figure 4:
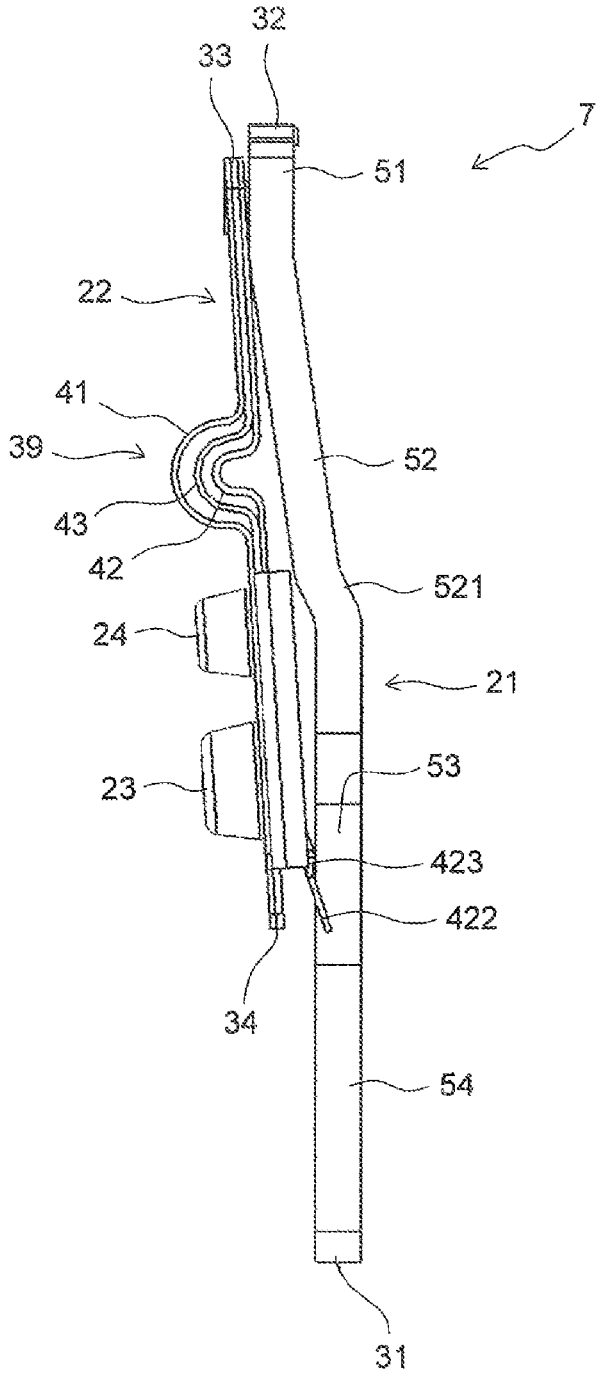
FIG. 4 is a plan view of a contact piece unit according to the embodiment.
Figure 5:
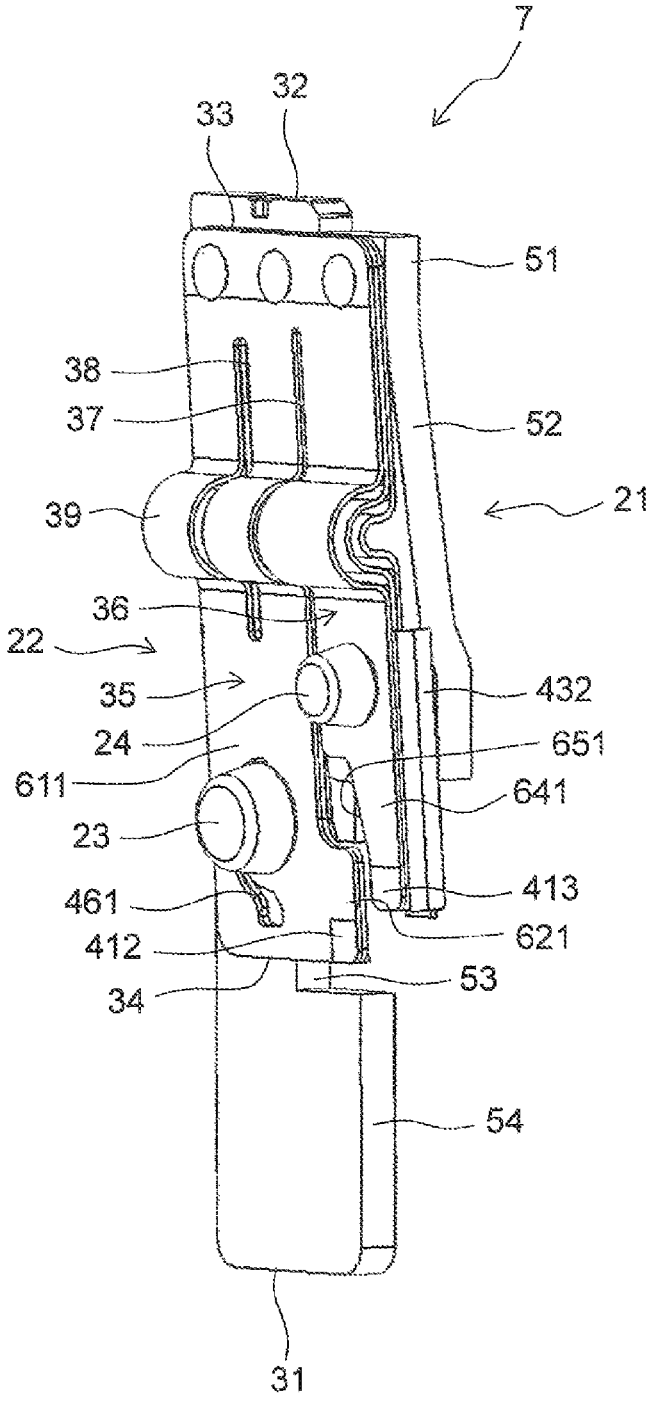
FIG. 5 is a perspective view of the contact piece unit.
Figure 6:
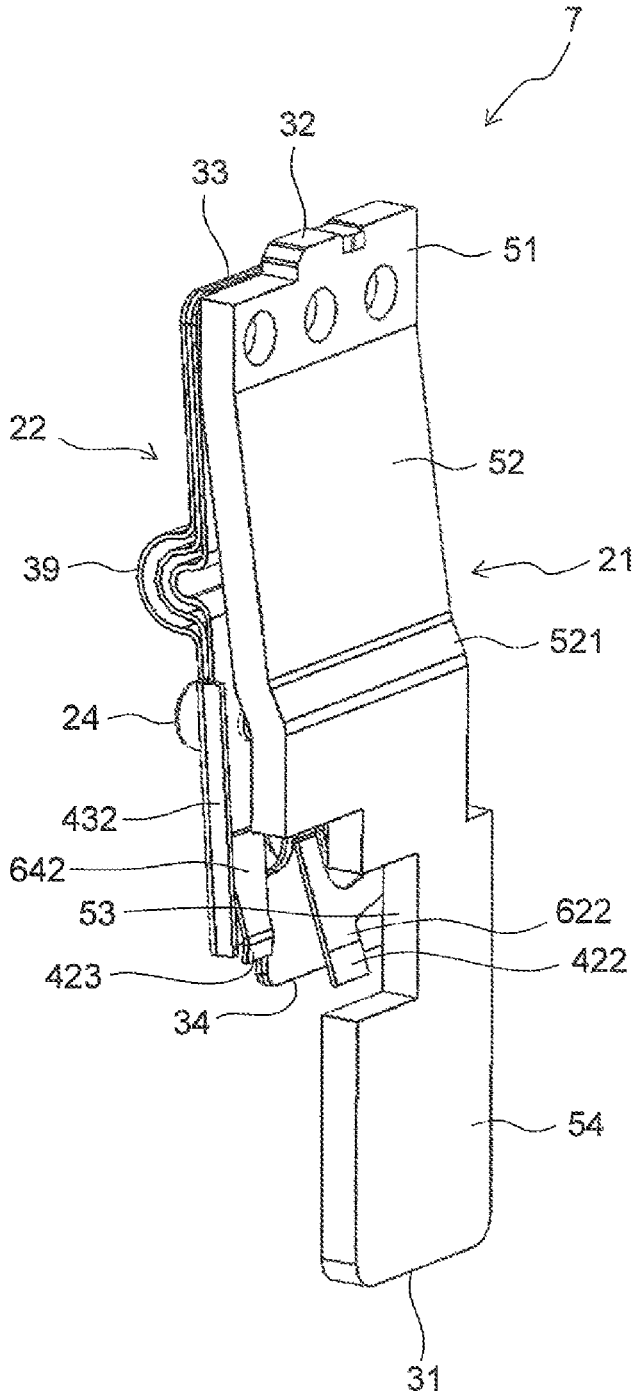
FIG. 6 is a perspective view of the contact piece unit.
Figure 7:
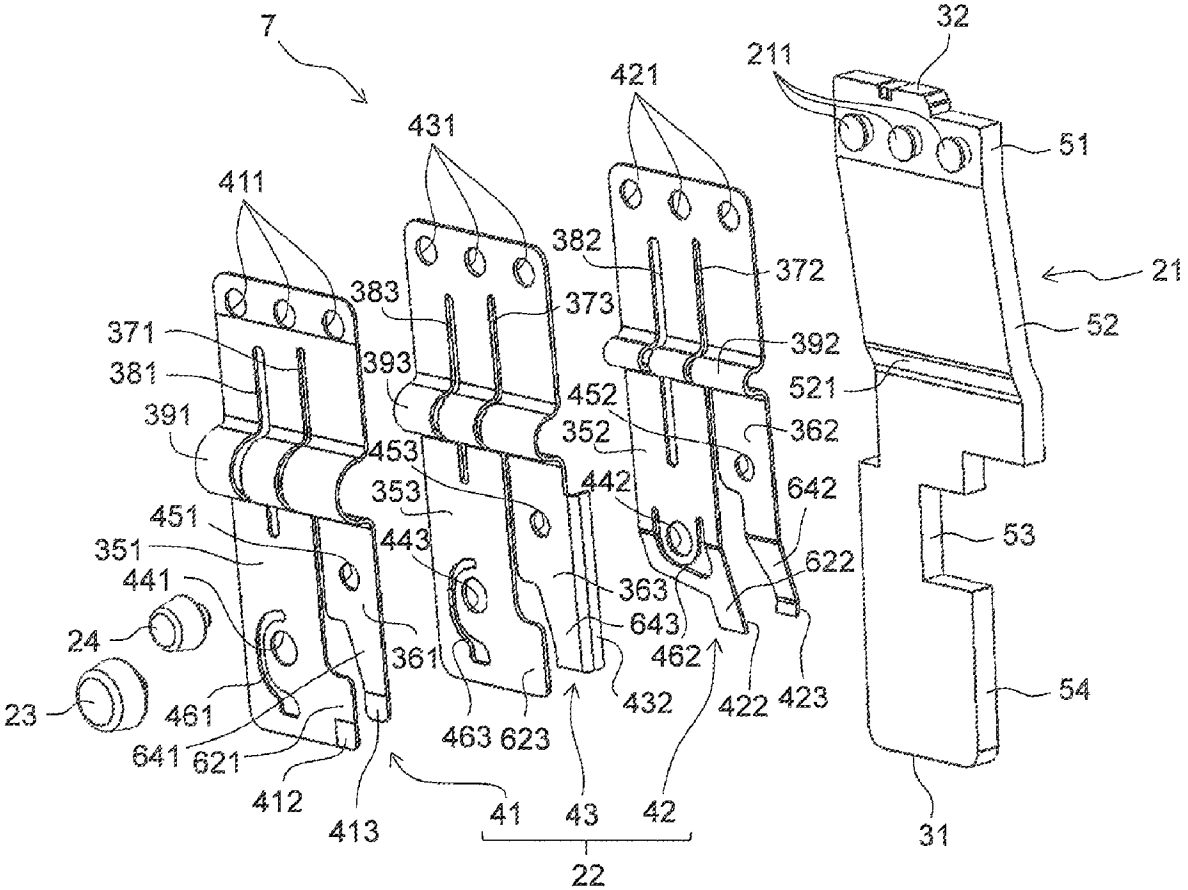
FIG. 7 is an exploded perspective view of the contact piece unit.
Figure 8:
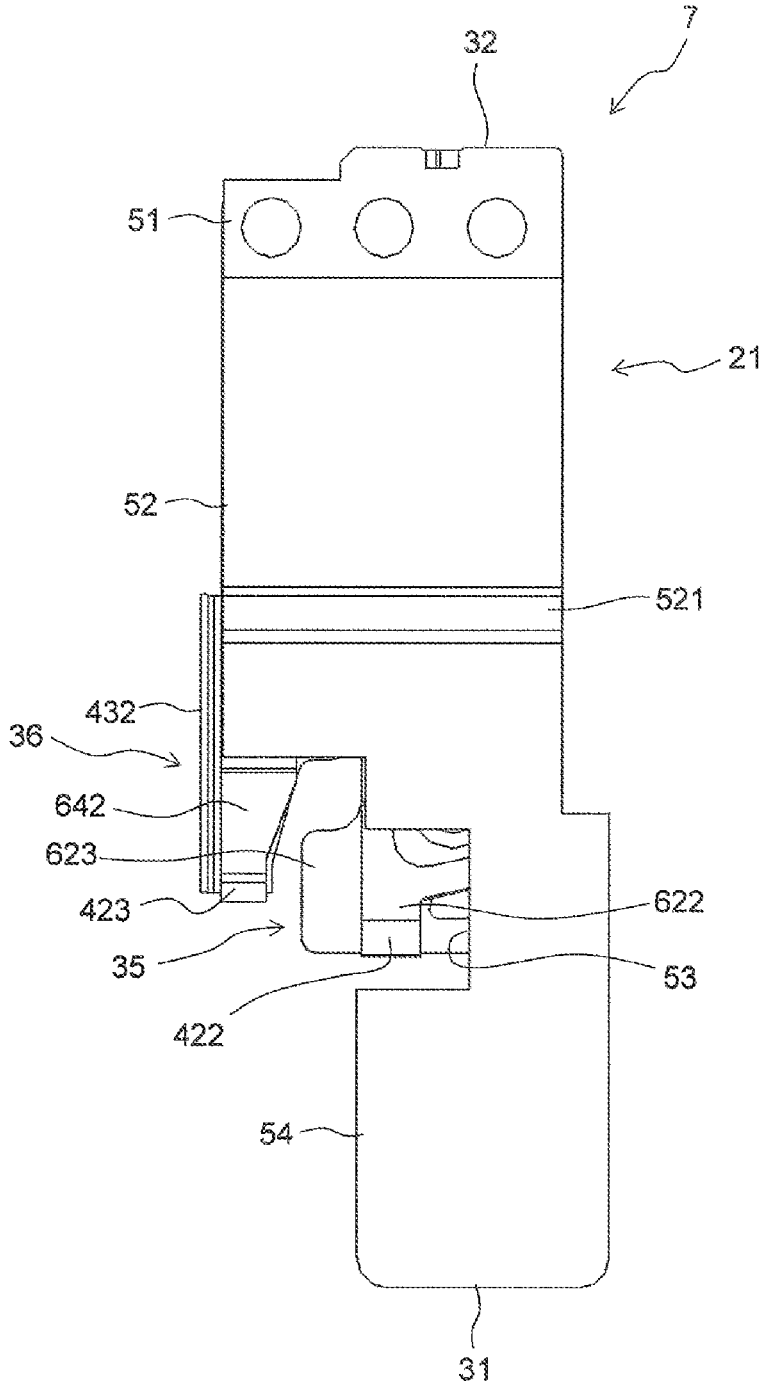
FIG. 8 is a side view of the contact piece unit.
Figure 9:
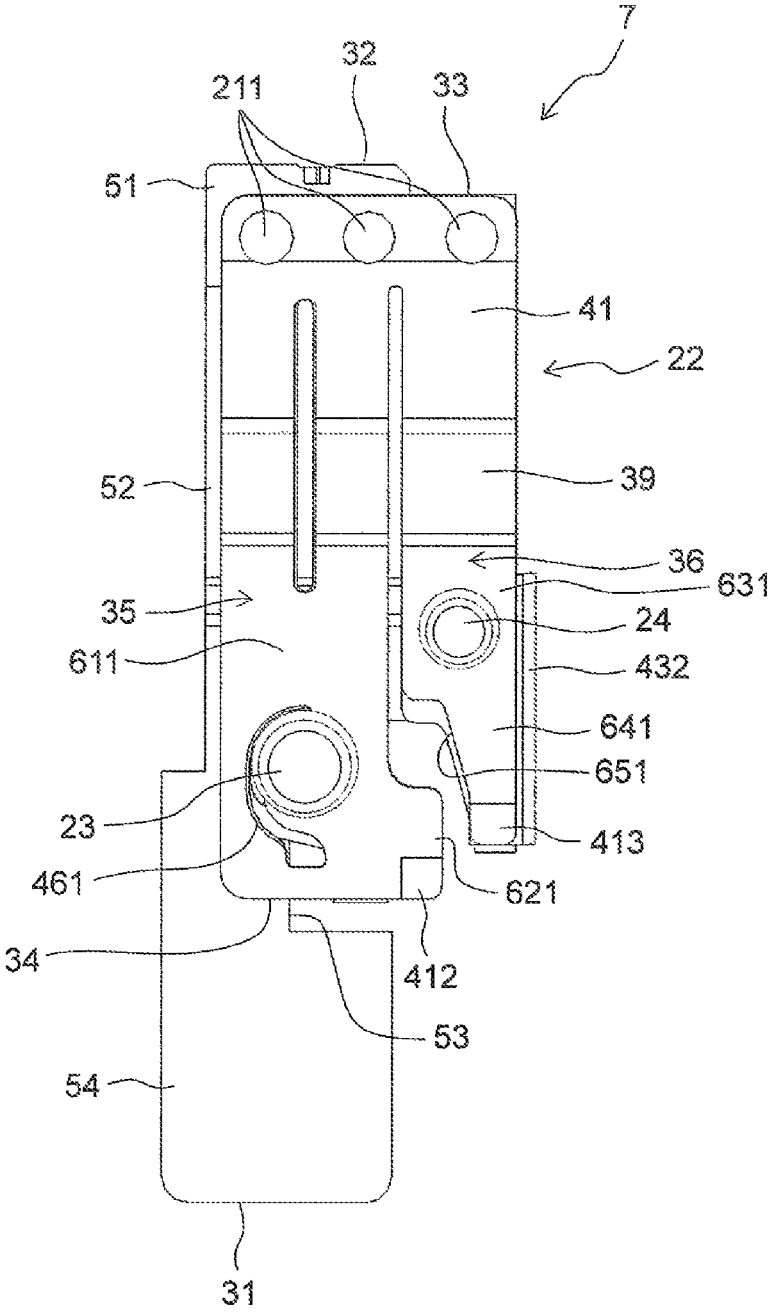
FIG. 9 is a side view of the contact piece unit.

Next, the contact piece unit 7 is described. FIG. 4 is a plan view of the contact piece unit 7. FIGS. 5 and 6 are perspective views of the contact piece unit 7. FIG. 7 is an exploded perspective view of the contact piece unit 7. FIG. 8 is a side view of the contact piece unit 7 as viewed from the movable contact terminal 21 side. FIG. 9 is a side view of the contact piece unit 7 as viewed from the contact piece 22 side.

As illustrated in FIGS. 4 to 9, the movable contact terminal 21 has an elongate plate shape. The movable contact terminal 21 includes a leading end portion 31 and a proximal end portion 32. As illustrated in FIG. 2, the leading end portion 31 of the movable contact terminal 21 is so disposed as to project to the outside of the base 2. The proximal end portion 32 of the movable contact terminal 21 is disposed inside the base 2.

According to the embodiment, a direction in parallel to a direction extending from the proximal end portion 32 toward the leading end portion 31 is referred to as a lengthwise direction. The lengthwise direction corresponds to an up-down direction in FIG. 4. A direction perpendicular to the lengthwise direction and a plate thickness direction of the movable contact terminal 21 is referred to as a widthwise direction. The plate thickness direction of the movable contact terminal 21 corresponds to a right-left direction in FIG. 4. The widthwise direction is a direction perpendicular to the sheet of FIG. 4, and corresponds to a right-left direction in FIGS. 8 and 9.

The movable contacts 23 and 24 include the first movable contact 23 and the second movable contact 24, respectively. The first movable contact 23 and the second movable contact 24 are separated from each other in the lengthwise direction of the contact piece 22. More specifically, the first movable contact 23 is located at the leading end side of the contact piece 22 with respect to the second movable contact 24. A diameter of the first movable contact 23 is larger than a diameter of the second movable contact 24. A height of the first movable contact 23 from the contact piece 22 is larger than a height of the second movable contact 24 from the contact piece 22. The number of the movable contacts is not limited to two, but may be a number larger than two.

The contact piece 22 is connected with the proximal end portion 32 of the movable contact terminal 21. The contact piece 22 has a plate shape elongated in the lengthwise direction of the movable contact terminal 21. The contact piece 22 has a proximal end portion 33 and a leading end portion 34. The proximal end portion 33 of the contact piece 22 is joined to the movable contact terminal 21. The leading end portion 34 of the contact piece 22 is a free end located on the side opposite to the proximal end portion 33. Accordingly, the proximal end portion 33 of the contact piece 22 is supported on the movable contact terminal 21 in a cantilevered manner.

As illustrated in FIG. 5, the contact piece 22 includes a first divided piece 35 and a second divided piece 36. The first divided piece 35 is located on the base 2 side of the second divided piece 36. The contact piece 22 includes a slit 37 formed between the first divided piece 35 and the second divided piece 36. The first divided piece 35 and the second divided piece 36 are separated from each other by the slit 37. The slit 37 extends lengthwise from the leading end portion 34 of the contact piece 22 toward the proximal end portion 33. The slit 37 does not reach the proximal end portion 33. The first divided piece 35 and the second divided piece 36 are therefore connected with each other at the proximal end side of the slit 37. The first movable contact 23 is attached to the first divided piece 35. The second movable contact 24 is attached to the second divided piece 36.

The first divided piece 35 includes a slit 38. The slit 38 is formed between the first movable contact 23, and a portion connected with the movable contact terminal 21. A width of the first divided piece 35 is larger than a width of the second divided piece 36. In other words, the second divided piece 36 has a width smaller than a width of the first divided piece 35. A leading end of the first divided piece 35 is located on a leading end side of the movable contact terminal 21 with respect to a leading end of the second divided piece 36.

As illustrated in FIG. 9, the first divided piece 35 includes a first contact portion 412. The first contact portion 412 is provided at a leading end portion of the first divided piece 35. The first contact portion 412 is provided on a surface at the fixed contact terminal 25 side of the first divided piece 35.

More specifically, the first divided piece 35 includes a first body 611 and a projection 621. The first body 611 extends in the lengthwise direction. The first movable contact 23 is attached to the first body 611. The projection 621 projects in the widthwise direction from the first body 611. The projection 621 projects in the widthwise direction toward the second divided piece 36 from the first divided piece 35. The first contact portion 412 is provided on the projection 621.

The first contact portion 412 is located at a portion of the first divided piece 35 on a leading end side with respect to the first movable contact 23. The first contact portion 412 is provided at a corner of the leading end of the first divided piece 35. The first contact portion 412 deviates in the widthwise direction from the position of the first movable contact 23.

The first divided piece 35 includes a first slit 461. The first slit 461 is disposed around the first movable contact 23. The first slit 461 has a shape curved along the first movable contact 23. The first slit 461 is disposed on a side opposite to the projection 621 with respect to the first movable contact 23.

The second divided piece 36 includes a second body 631 and a tapered portion 641. The second body 631 extends in the lengthwise direction. The second movable contact 24 is attached to the second body 631. The tapered portion 641 is located on a leading end side of the second body 631. The tapered portion 641 is so shaped as to decrease in width with nearness to the leading end.

The second divided piece 36 includes a recess 651 at a portion containing the tapered portion 641. The recess 651 is disposed at a position facing the projection 621 of the first divided piece 35. The recess 651 has a shape recessed to avoid overlap with the projection 621. The recess 651 is disposed at a position facing the first movable contact 23 in the widthwise direction. The second movable contact 24 is located at a portion of the second divided piece 36 on a proximal end side with respect to the recess 651.

The second divided piece 36 includes a second contact portion 413. The second contact portion 413 is provided on a surface at the fixed contact terminal 25 side of the second divided piece 36. The second contact portion 413 is disposed at a position facing the projection 621 in the widthwise direction. The second contact portion 413 is provided at a leading end of the second divided piece 36. In other words, the second contact portion 413 is provided at a leading end of the tapered portion 641. The first divided piece 35 is longer than the second divided piece 36 in the lengthwise direction. Accordingly, the first contact portion 412 is located on the leading end side with respect to the second contact portion 413.

As illustrated in FIG. 8, the first divided piece 35 includes a third contact portion 422. The third contact portion 422 is provided at the leading end of the first divided piece 35. The third contact portion 422 is provided on a surface at the movable contact terminal 21 side of the first divided piece 35. At least a part of the third contact portion 422 is located at a position closer to the first movable contact 23 than the first contact portion 412 in the widthwise direction. The second divided piece 36 includes a fourth contact portion 423. The fourth contact portion 423 is provided at a leading end of the second divided piece 362. The fourth contact portion 423 is provided on a surface at the movable contact terminal 21 side of the second divided piece 362. The third contact portion 422 is located on a leading end side of the contact piece 22 with respect to the fourth contact portion 423.

As illustrated in FIG. 5, the contact piece 22 includes an expanded portion 39. The expanded portion 39 has a curved shape protruding in a direction away from the movable contact terminal 21. The expanded portion 39 projects from the movable contacts 23 and 24 toward the fixed contacts 26 and 27. The expanded portion 39 extends in the widthwise direction of the contact piece 22. The expanded portion 39 is located between the proximal end portion 33 of the contact piece 22 and the movable contacts 23 and 24 in the lengthwise direction of the contact piece 22.

As illustrated in FIG. 7, the contact piece unit 7 includes a plurality of leaf springs 41 to 43. The plurality of leaf springs 41 to 43 are laminated on each other. More specifically, the contact piece unit 7 includes the first leaf spring 41, the second leaf spring 42, and the third leaf spring 43. In the plurality of leaf springs 41 to 43, the first leaf spring 41 is disposed at a position farthest from the movable contact terminal 21. In the plurality of leaf springs 41 to 43, the second leaf spring 42 is disposed at a position closest to the movable contact terminal 21. The third leaf spring 43 is disposed between the first leaf spring 41 and the second leaf spring 42.

The number of the leaf springs is not limited to three, but may be a number smaller than three. Alternatively, the number of the leaf springs may be a number larger than three.

The first leaf spring 41 includes connection holes 411. The second leaf spring 42 includes connection holes 421. The third leaf spring 43 includes connection holes 431. The movable contact terminal 21 includes a connection projection 211. The connection projection 211 is inserted into the connection holes 411, 421, and 431 of the first to third leaf springs 41 to 43 to connect the first to third leaf springs 41 to 43 and the movable contact terminal 21 integrally.

The first leaf spring 41 includes a first divided piece 351 and a second divided piece 361. The second leaf spring 42 includes a first divided piece 352 and a second divided piece 362. The third leaf spring 43 includes a first divided piece 353 and a second divided piece 363. The plurality of first divided pieces 351 to 353 are laminated on each other to constitute the first divided piece 35 of the contact piece 22 described above. The plurality of second divided pieces 361 to 363 are laminated on each other to constitute the second divided piece 36 of the contact piece 22 described above.

The first leaf spring 41, the second leaf spring 42, and the third leaf spring 43 include first contact attaching portions 441, 442, and 443, respectively. The first contact attaching portions 441 to 443 are attachment holes formed in the first to third leaf springs 41 to 43, respectively, and are so disposed as to overlap with each other. The first movable contact 23 is attached to the first contact attaching portions 441 to 443.

The first leaf spring 41, the second leaf spring 42, and the third leaf spring 43 include second contact attaching portions 451, 452, and 453, respectively. The second contact attaching portions 451 to 453 are attachment holes formed in the first to third leaf springs 41 to 43, respectively, and are so disposed as to overlap with each other. The second movable contact 24 is attached to the second contact attaching portions 451 to 453.

The first leaf spring 41 includes the first slit 461 described above. The first slit 461 is formed around the first contact attaching portion 441. The first slit 461 has a shape curved along a part of the first contact attaching portion 441. The second leaf spring 42 includes a second slit 462. The second slit 462 is formed around the first contact attaching portion 442. The second slit 462 has a shape curved along a part of the first contact attaching portion 442. The third leaf spring 43 includes a third slit 463. The third slit 463 has a shape similar to the shape of the first slit 461.

The first leaf spring 41, the second leaf spring 42, and the third leaf spring 43 include slits 371 to 373, respectively. The slits 371 to 373 are so disposed as to overlap with each other, and constitute the slit 37 described above. The first leaf spring 41, the second leaf spring 42, and the third leaf spring 43 include slits 381 to 383, respectively. The slits 381 to 383 are so disposed as to overlap with each other, and constitute the slit 38 described above.

The first leaf spring 41, the second leaf spring 42, and the third leaf spring 43 include expanded portions 391 to 393, respectively. The expanded portions 391 to 393 are so disposed as to overlap with each other, and constitute the expanded portion 39 described above.

The first leaf spring 41 includes the projection 621 described above. The first leaf spring 41 includes the tapered portion 641 described above. The first leaf spring 41 includes the first contact portion 412 and the second contact portion 413 described above.

The second leaf spring 42 includes the third contact portion 422 and the fourth contact portion 423 described above. The second leaf spring 42 includes a tapered portion 642 having a shape similar to a shape of the tapered portion 641 of the first leaf spring 41. The fourth contact portion 423 is provided at a leading end of the tapered portion 642 of the second leaf spring 42.

The second leaf spring 42 includes a projection 622 having a shape different from the shape of the projection 621 of the first leaf spring 41. The projection 622 of the second leaf spring 42 projects in the lengthwise direction. The projection 622 of the second leaf spring 42 overlaps with the first leaf spring 41 in a direction perpendicular to a surface of the contact piece 22. The third contact portion 422 is provided at a leading end of the projection 622 of the second leaf spring 42.

A leading end portion of the second leaf spring 42 is bent toward the movable contact terminal 21. This configuration stabilizes a contact pressure of the contacts in the set state of the relay 1.

The third leaf spring 43 includes a projection 623 having a shape similar to the shape of the projection 621 of the first leaf spring 41. The third leaf spring 43 includes a tapered portion 643 having a shape similar to the shape of the tapered portion 641 of the first leaf spring 41. A rib 432 is provided on the third leaf spring 43. The rib 432 is provided at an edge of the second divided piece 363 of the third leaf spring 43, and extends in the lengthwise direction of the contact piece 22. The rib 432 has a shape bent toward the movable contact terminal 21. The rib 432 increases rigidity of the second divided piece 36.

The movable contact terminal 21 includes a connection portion 51, a body 52, a recess 53, and a distal end portion 54. The connection portion 51 includes the proximal end portion 32 of the movable contact terminal 21. The connection portion 51 includes the connection projections 211 described above. The proximal end portion 33 of the contact piece 22 is connected with the connection projections 211.

The body 52 extends in the lengthwise direction of the contact piece 22 from the connection portion 51. As illustrated in FIGS. 4 to 6, the body 52 faces the expanded portion 39 of the contact piece 22. The body 52 includes a bent portion 521 having a bent shape. A proximal end side of the body 52 with respect to the bent portion 521 is inclined toward the contact piece 22 with nearness to the proximal end portion 32.

The recess 53 overlaps with a portion of the contact piece 22 on a leading end side with respect to the first movable contact 23. The recess 53 is located between the body 52 and the distal end portion 54. As illustrated in FIG. 2, the link member 6 is so disposed as to pass through the recess 53.

The distal end portion 54 is located on a leading end side of the recess 53. The distal end portion 54 includes the leading end portion 31 of the movable contact terminal 21. The distal end portion 54 is constituted by the movable contact terminal 21 at a portion projecting to the outside of the base 2.

The fixed contacts 26 and 27 include the first fixed contact 26 and the second fixed contact 27, respectively. The first fixed contact 26 is attached to the fixed contact terminal 25, and disposed at a position facing the first movable contact 23. The second fixed contact 27 is attached to the fixed contact terminal 25, and disposed at a position facing the second movable contact 24. The first fixed contact 26 and the second fixed contact 27 are disposed away from each other in the lengthwise direction of the contact piece 22 similarly to the first movable contact 23 and the second movable contact 24. The first fixed contact 26 is disposed on a leading end side of the contact piece 22 with respect to the second fixed contact 27.

A diameter of the first fixed contact 26 is larger than a diameter of the second fixed contact 27. A height of the first fixed contact 26 from the fixed contact terminal 25 is larger than a height of the second fixed contact 27 from the fixed contact terminal 25. As described above, the height of the first movable contact 23 from the contact piece 22 is larger than the height of the second movable contact 24 from the contact piece 22.

Accordingly, at the time of contact between the contacts, the first movable contact 23 comes into contact with the first fixed contact 26 prior to contact between the second movable contact 24 and the second fixed contact 27. At the time of separation between the contacts, the first movable contact 23 separates from the first fixed contact 26 after separation of the second movable contact 24 from the second fixed contact 27. Accordingly, an electric load produced at the time of contact between the contacts or separation between the contacts is chiefly applied to the first movable contact 23. Each of the first movable contact 23 and the first fixed contact 26 therefore functions as an open/close contact. On the other hand, each of the second movable contact 24 and the second fixed contact 27 functions as an energization contact.

Figure 10:
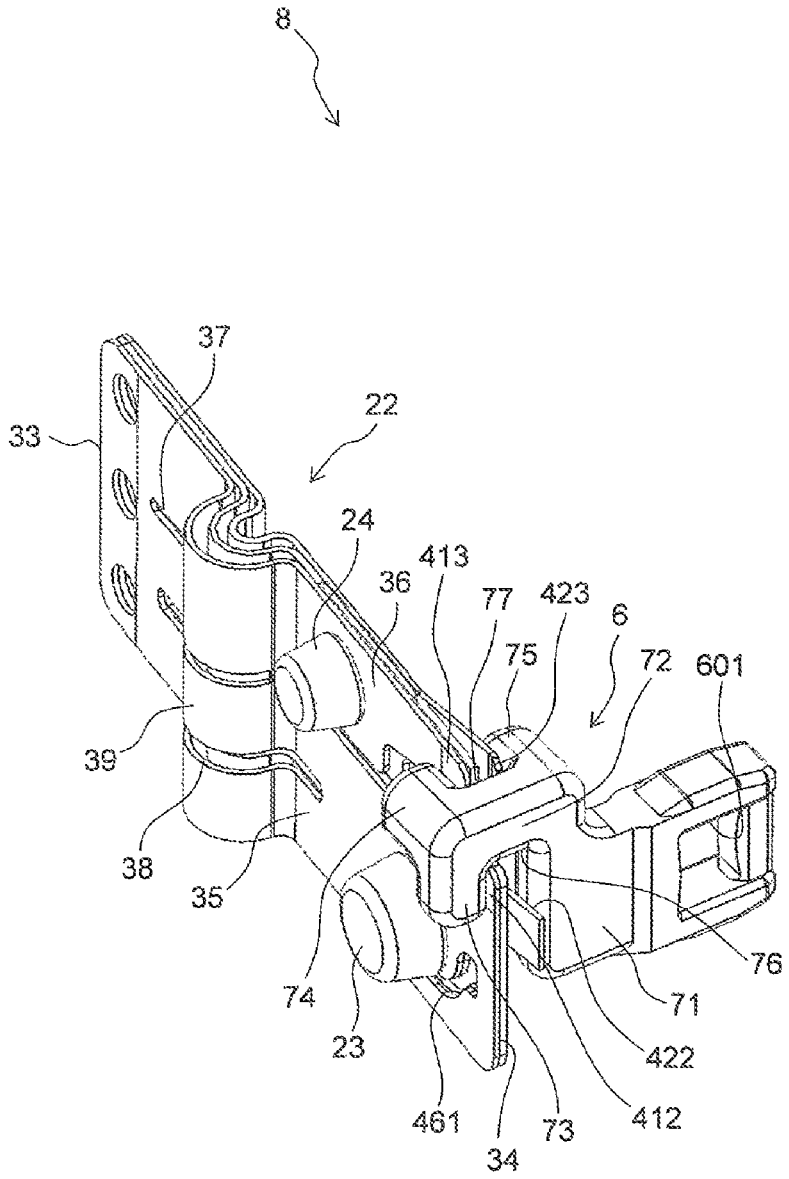
FIG. 10 is a perspective view of a contact piece and a link member.
Figure 11:
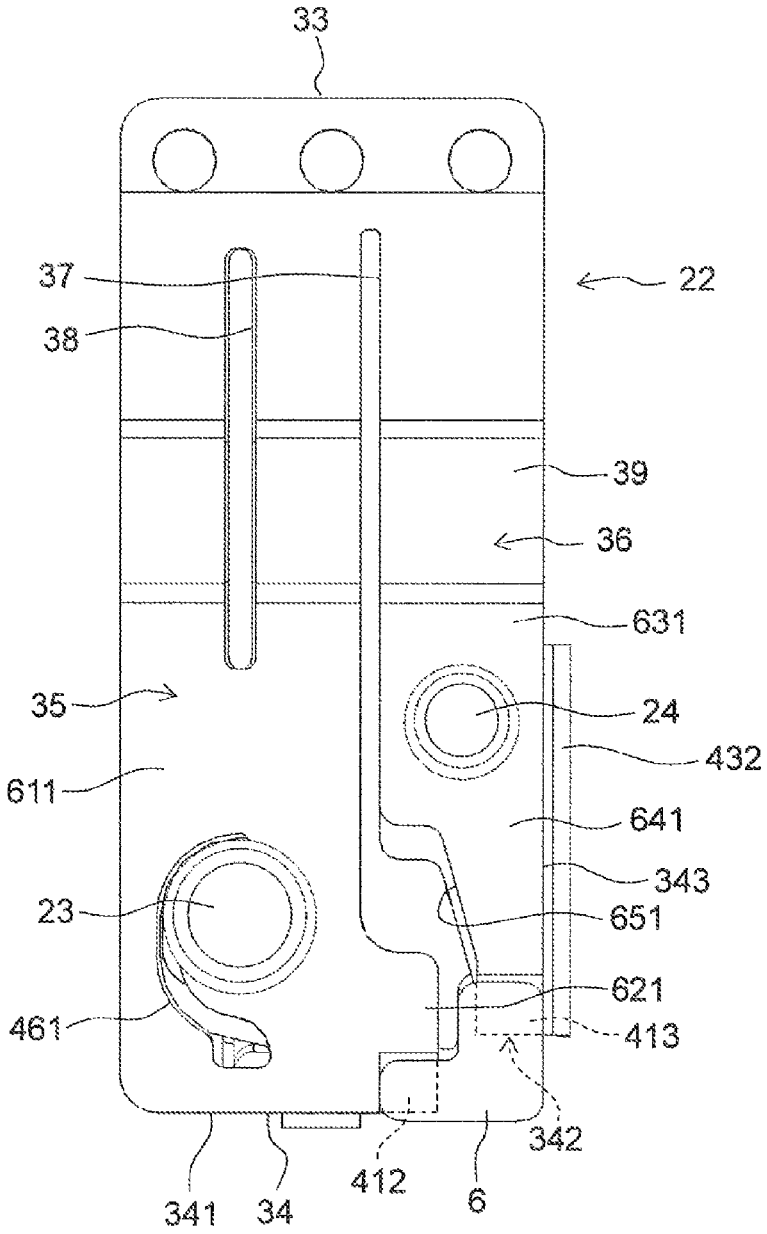
FIG. 11 is a side view of the contact piece and the link member.
Figure 12:
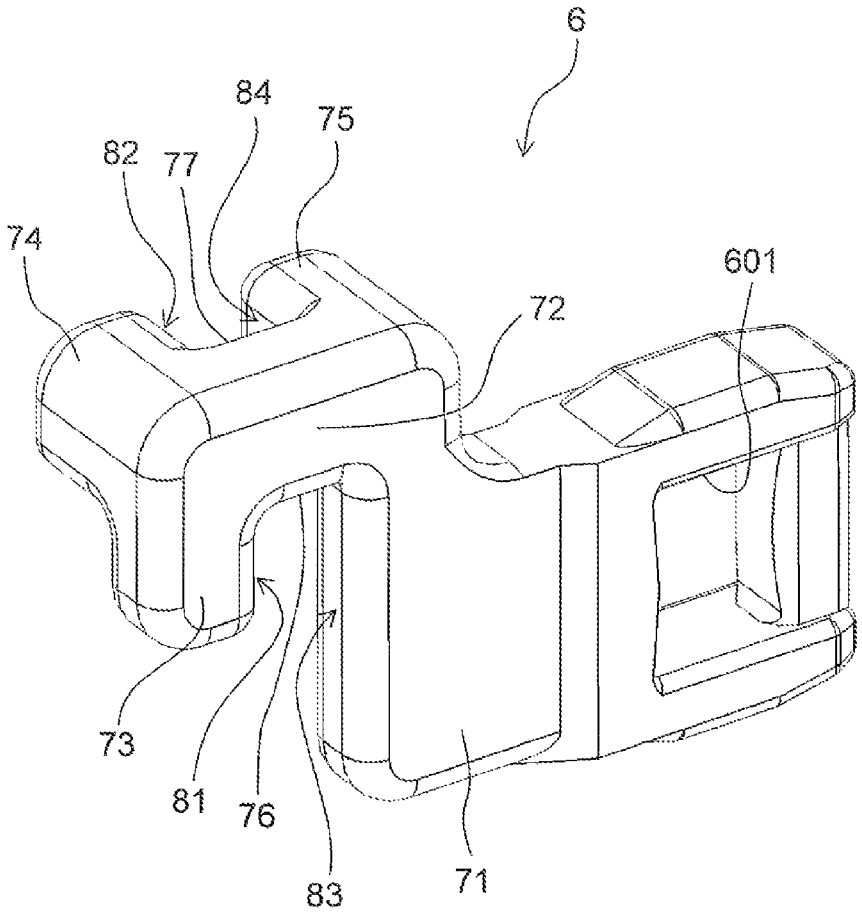
FIG. 12 is a perspective view of the link member.
Figure 13:
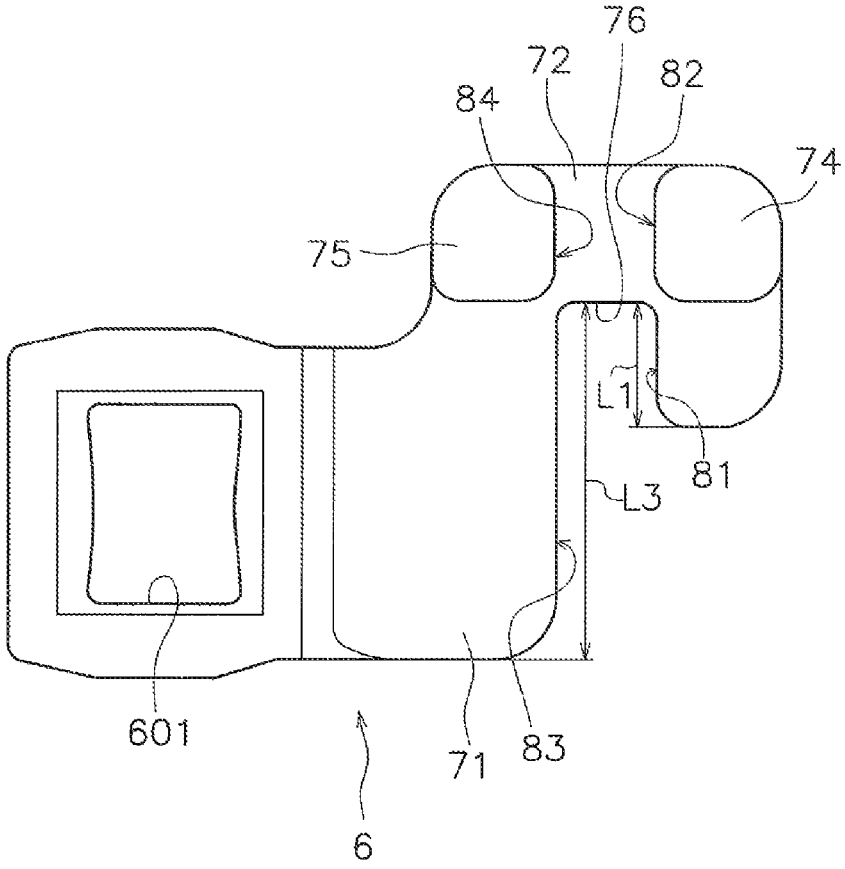
FIG. 13 is a view illustrating the link member as viewed from a proximal end side of the contact piece.

Next, the link member 6 is described in detail. FIG. 10 is a perspective view illustrating the link member 6 and the contact piece 22. FIG. 11 is a side view of the link member 6 and the contact piece 22 as viewed from the fixed contact terminal 25 side. FIG. 12 is a perspective view of the link member 6. FIG. 13 is a view illustrating the link member 6 as viewed from the proximal end side of the contact piece 22.

In the following description, a "lengthwise direction" refers to a lengthwise direction of the contact piece 22, and corresponds to a direction in parallel with the direction from the proximal end portion 32 to the leading end portion 31 of the contact piece 22 as described above. The lengthwise direction corresponds to an up-down direction in FIG. 11. A "widthwise direction" refers to a widthwise direction of the contact piece 22, and corresponds to a direction in which the first divided piece 35 and the second divided piece 36 are lined. The widthwise direction corresponds to an up-down direction in FIG. 10, and a right-left direction in FIG. 11.

As illustrated in FIGS. 10 and 12, the link member 6 includes a body 71, a junction 72, a first projection 73, a second projection 74, and a third projection 75. The body 71 has a plate shape extending from the contact piece 22 toward the fixed contact terminal 25. The body 71 includes the connection hole 601 described above. The body 71 is so disposed as to pass through the recess 53 of the movable contact terminal 21.

In the following description, a direction from the contact piece 22 toward the fixed contact terminal 25 is referred to as a "contact direction". A direction opposite to the contact direction is referred to as a "separation direction".

The junction 72 projects in the contact direction from the body 71. The junction 72 extends in the contact direction from the body 71. The first projection 73 projects in the widthwise direction from the junction 72. More specifically, the first projection 73 projects from the junction 72 in a direction from the second divided piece 36 toward the first divided piece 35.

The second projection 74 and the third projection 75 project in the same direction and extend in parallel with each other. The first projection 73 projects in a direction perpendicular to the projection direction of the second projection 74.

The second projection 74 projects in the lengthwise direction from the junction 72. More specifically, the second projection 74 projects from the junction 72 toward the proximal end of the contact piece 22. The third projection 75 projects in the lengthwise direction from the junction 72. The third projection 75 projects from the junction 72 toward the proximal end of the contact piece 22. The third projection 75 is located in the separation direction from the second projection 74.

The link member 6 includes a first recess 76 and a second recess 77. The first recess 76 is formed by the junction 72, the first projection 73, and an end of the body 71 in the contact direction. The first recess 76 has a shape recessed in the widthwise direction of the contact piece 22. The first recess 76 is recessed in a direction from the first divided piece 35 toward the second divided piece 36. As illustrated in FIG. 10, the leading end of the first divided piece 35 is disposed inside the first recess 76. The first contact portion 412 and the third contact portion 422 are disposed inside the first recess 76.

The second recess 77 is formed by the junction 72, the second projection 74, and the third projection 75. The second recess 77 has a shape recessed in the lengthwise direction of the contact piece 22. The second recess 77 is recessed in a direction from the proximal end toward the leading end of the contact piece 22. The leading end of the second divided piece 36 is disposed inside the second recess 77. The second contact portion 413 and the fourth contact portion 423 are disposed inside the second recess 77.

As illustrated in FIG. 11, the link member 6 is located between a leading end 341 of the first divided piece 35 and a leading end 342 of the second divided piece 36 in the lengthwise direction. The link member 6 is located between the projection 621 of the first divided piece 35 and a widthwise edge 343 of the second divided piece 36 in the widthwise direction. The link member 6 is disposed in a range of the width of the contact piece 22.

As illustrated in FIG. 12, the link member 6 includes a first pressing portion 81, a second pressing portion 82, a third pressing portion 83, and a fourth pressing portion 84. The first pressing portion 81 is provided on the first projection 73. The first pressing portion 81 constitutes a part of the first recess 76, and extends in the widthwise direction of the contact piece 22. The first pressing portion 81 is disposed at a position facing the first contact portion 412. The first pressing portion 81 presses the first contact portion 412 in the separation direction in accordance with movement of the link member 6 in the separation direction.

The second pressing portion 82 is provided on the second projection 74. The second pressing portion 82 constitutes a part of the second recess 77, and extends in the lengthwise direction of the contact piece 22. More specifically, the second pressing portion 82 extends toward the proximal end of the contact piece 22 in the lengthwise direction. The second pressing portion 82 is disposed at a position facing the second contact portion 413. The second pressing portion 82 presses the second contact portion 413 in the separation direction in accordance with movement of the link member 6 in the separation direction.

The third pressing portion 83 is provided at an end of the body 71 in the contact direction. The third pressing portion 83 constitutes a part of the first recess 76, and extends in the widthwise direction of the contact piece 22. The third pressing portion 83 is disposed at a position facing the third contact portion 422. The third pressing portion 83 presses the third contact portion 422 in the contact direction in accordance with movement of the link member 6 in the contact direction.

The fourth pressing portion 84 is provided on the third projection 75. The fourth pressing portion 84 constitutes a part of the second recess 77, and extends in the lengthwise direction of the contact piece 22. More specifically, the fourth pressing portion 84 extends toward the proximal end of the contact piece 22 in the lengthwise direction. The fourth pressing portion 84 is disposed at a position facing the fourth contact portion 423. The fourth pressing portion 84 presses the fourth contact portion 423 in the contact direction in accordance with movement of the link member 6 in the contact direction.

As illustrated in FIG. 13, a length L1 of the first pressing portion 81 in the widthwise direction is different from a length L3 of the third pressing portion 83 in the widthwise direction. Accordingly, the first pressing portion 81 and the third pressing portion 83 press different positions of the first divided piece 35 in the widthwise direction. More specifically, the first pressing portion 81 is shorter than the third pressing portion 83 in the widthwise direction. A length of the second pressing portion 82 in the lengthwise direction is equal to a length of the fourth pressing portion 84 in the lengthwise direction.

As illustrated in FIG. 13, the first pressing portion 81 is disposed in line with the second pressing portion 82 in the widthwise direction of the contact piece 22. Accordingly, when the link member 6 moves in the separation direction, the second pressing portion 82 comes into contact with the second contact portion 413 substantially at the same time as contact between the first pressing portion 81 and the first contact portion 412.

The third pressing portion 83 is disposed in line with the fourth pressing portion 84 in the widthwise direction of the contact piece 22. Accordingly, when the link member 6 moves in the contact direction, the fourth pressing portion 84 comes into contact with the fourth contact portion 423 substantially at the same time as contact between the third pressing portion 83 and the third contact portion 422.

Figure 14:
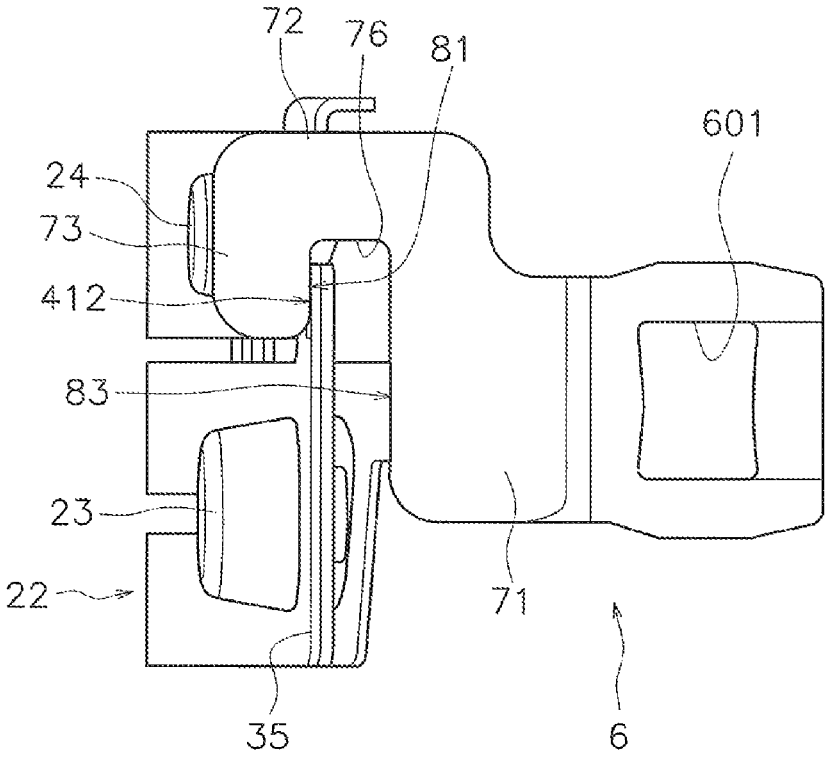
FIG. 14 is a view illustrating the contact piece and the link member in a reset state.
Figure 15:
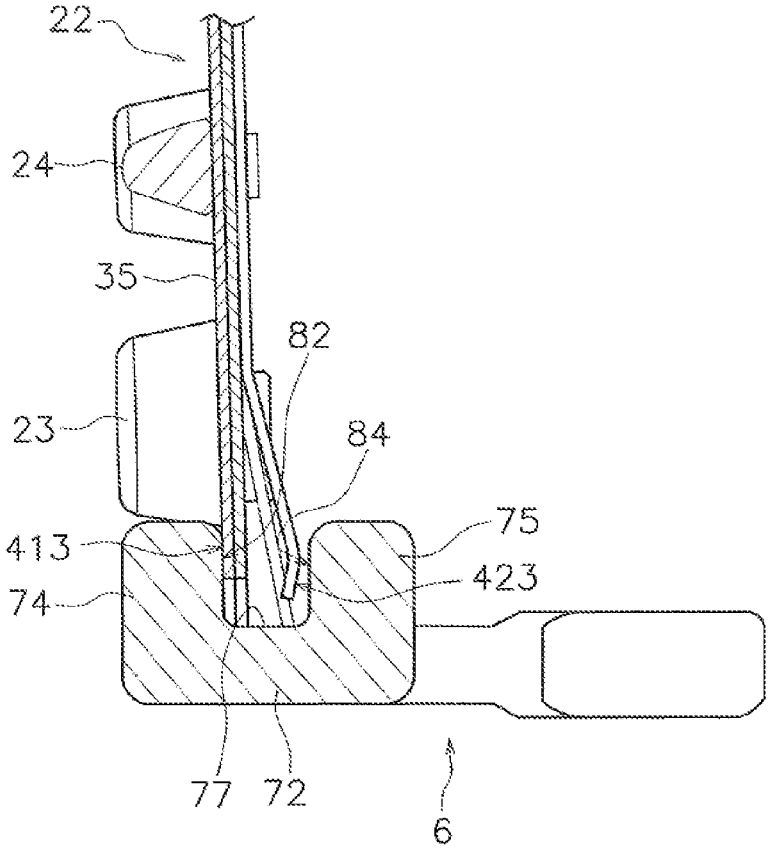
FIG. 15 is a view illustrating the contact piece and the link member in the reset state.

FIGS. 14 and 15 are views each illustrating the contact piece 22 and the link member 6 at the time of switching from the set state to the reset state of the relay 1. When the state of the relay 1 is switched from the set state to the reset state, the link member 6 moves in the separation direction (rightward in FIGS. 14 and 15.) In this case, the first pressing portion 81 comes into contact with the first contact portion 412, and presses the first contact portion 412 in the separation direction as illustrated in FIG. 14. In addition, the second pressing portion 82 comes into contact with the second contact portion 413, and presses the second contact portion 413 in the separation direction as illustrated in FIG. 15. In this case, the movable contacts 23 and 24 move in directions away from the fixed contacts 26 and 27, respectively, and separate from the fixed contacts 26 and 27. As a result, the set state of the relay 1 is switched to the reset state.

Figure 16:
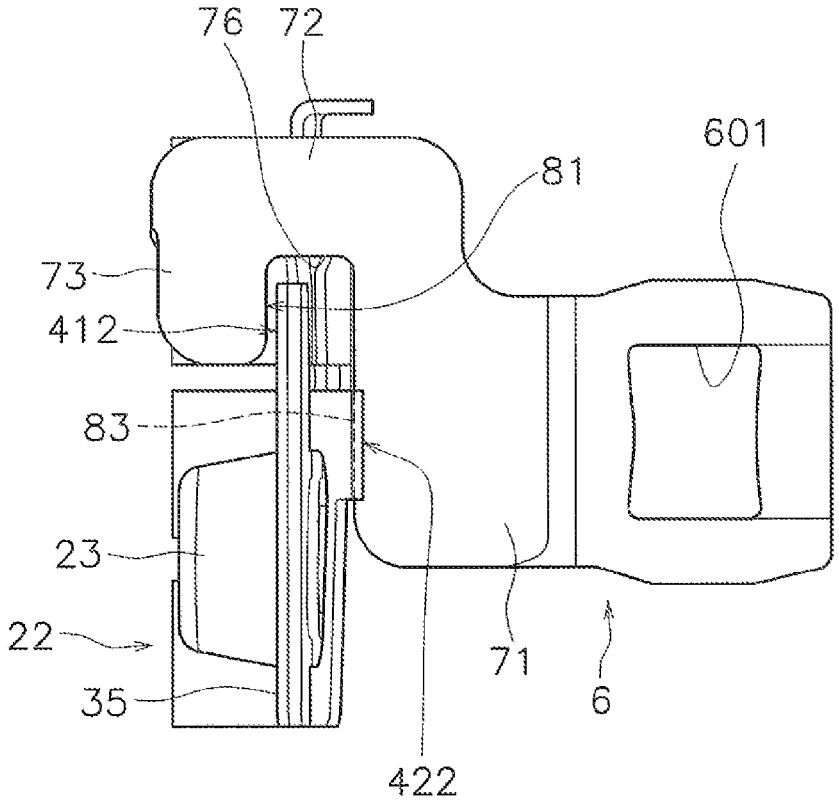
FIG. 16 is a view illustrating the contact piece and the link member in a set state.
Figure 17:
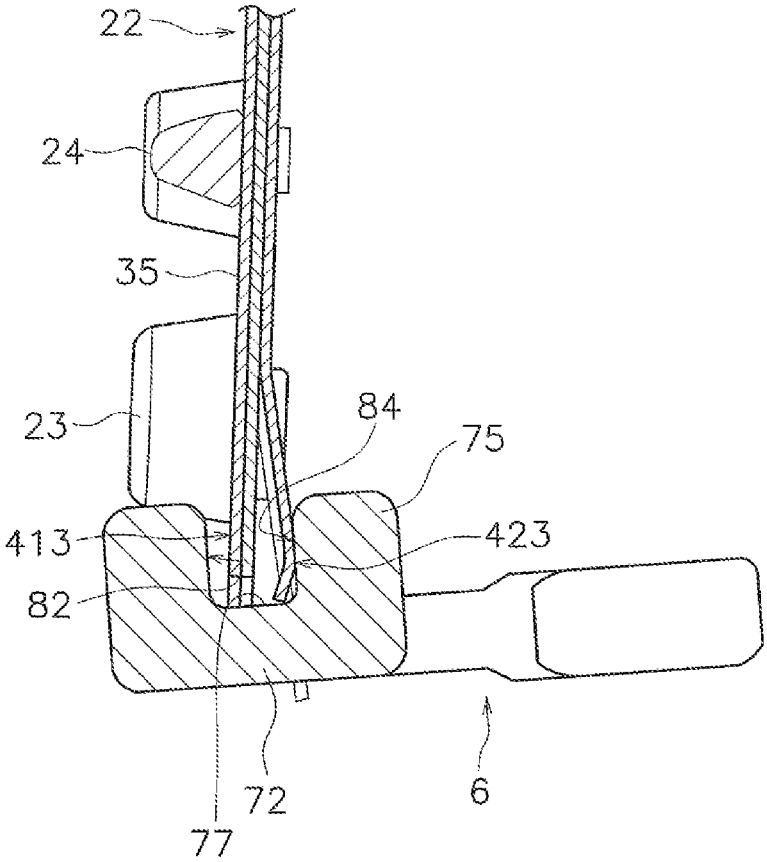
FIG. 17 is a view illustrating the contact piece and the link member in the set state.

FIGS. 16 and 17 are views each illustrating the contact piece 22 and the link member 6 when the state of the relay 1 is switched from the reset state to the set state. When the state of the relay 1 is switched from the reset state to the set state, the link member 6 moves in the contact direction (leftward in FIGS. 16 and 17). In this case, the third pressing portion 83 comes into contact with the third contact portion 422, and presses the third contact portion 422 in the contact direction as illustrated in FIG. 16. In addition, the fourth pressing portion 84 comes into contact with the fourth contact portion 423, and presses the fourth contact portion 423 in the contact direction as illustrated in FIG. 17. Accordingly, the movable contacts 23 and 24 move toward the fixed contacts 26 and 27, respectively, and come into contact with the fixed contacts 26 and 27. As a result, the reset state of the relay 1 is switched to the set state.

According to the relay in the embodiment described above, the first pressing portion 81 and the second pressing portion 82 extend in different directions. Accordingly, the positions or sizes of the first contact portion 412 and the second contact portion 413 are easily adjustable by freely setting dimensions of the first pressing portion 81 and the second pressing portion 82. Moreover, the strength of the separation force or timing of separation is easily adjustable for each of the first movable contact 23 and the second movable contact 24 by freely setting positions of the first pressing portion 81 and the second pressing portion 82. Accordingly, the contact parameters can be easily set.

Figure 18:
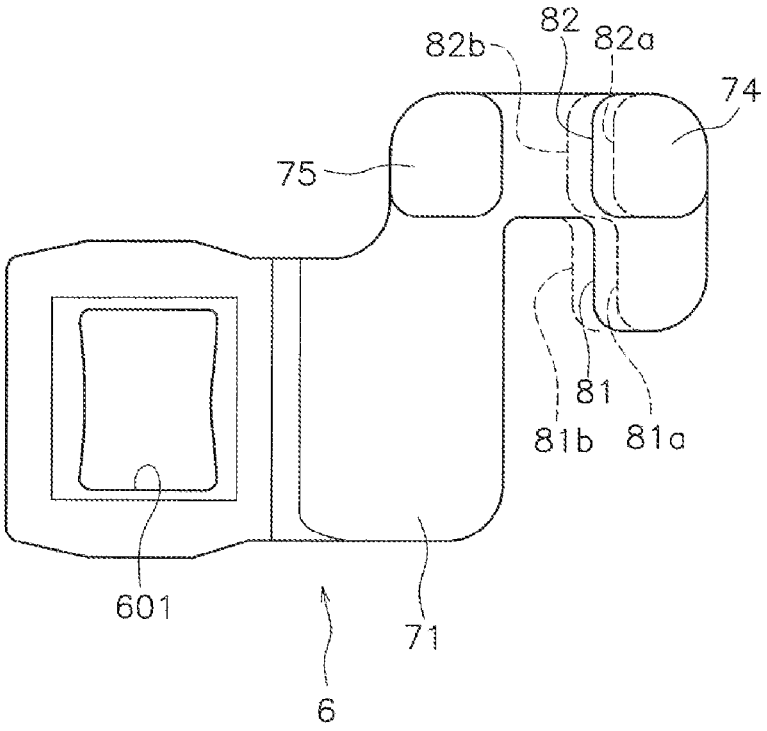
FIG. 18 is a view illustrating a method for adjusting separation force.

For example, a distance between the contact piece 22 and the first pressing portion 81 can be increased by shifting the first pressing portion 81 in the contact direction toward a position 81*a* illustrated in FIG. 18. In this case, a moving speed of the first pressing portion 81 at a moment of contact between the first pressing portion 81 and the contact piece 22 can be increased, so that the separation force of the first movable contact 23 can be increased. Similarly, the separation force of the second movable contact 24 can be increased by shifting the second pressing portion 82 in the contact direction toward a position 82*a*. Conversely, the separation force of the first movable contact 23 can be decreased by shifting the first pressing portion 81 in the separation direction toward a position 81*b*. Similarly, the separation force of the second movable contact 24 can be decreased by shifting the second pressing portion 82 in the separation direction toward a position 82*b*.

Moreover, the third pressing portion 83 and the fourth pressing portion 84 extend in different directions. Accordingly, the positions or sizes of the third contact portion 422 and the fourth contact portion 423 are easily adjustable by freely setting dimensions of the first pressing portion 81 and the second pressing portion 82. Furthermore, the strength of the contact force or timing of contact is easily adjustable for each of the first movable contact 23 and the second movable contact 24 by freely setting positions of the first pressing portion 81 and the second pressing portion 82. Accordingly, the contact parameters can be easily set.

Figure 19:
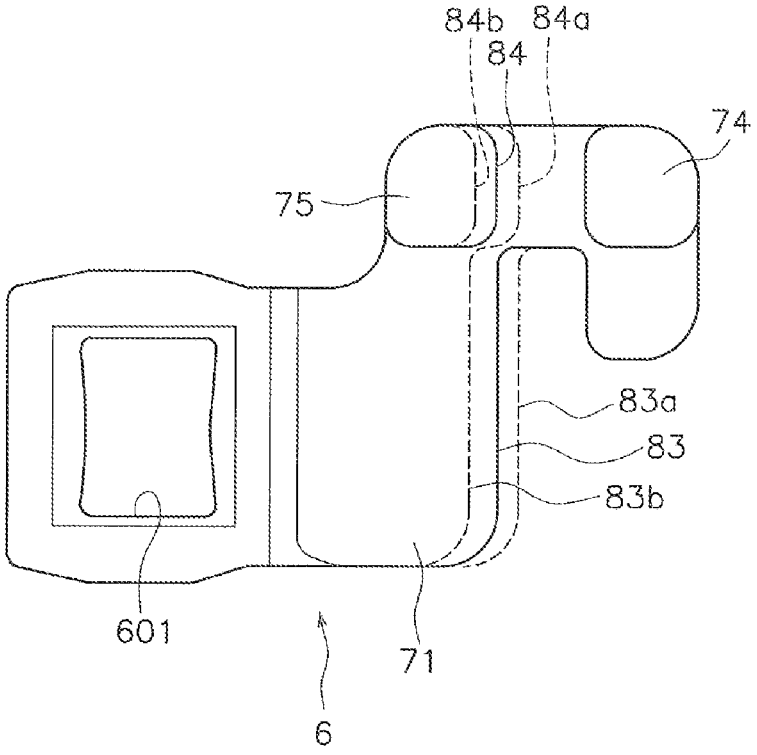
FIG. 19 is a view illustrating a method for adjusting contact force.

For example, pressing against the contact piece 22 by the third pressing portion 83 can be increased by shifting the third pressing portion 83 in the contact direction toward a position 83*a* illustrated in FIG. 19. Accordingly, the contact force of the first movable contact 23 can be increased. Similarly, the contact force of the second movable contact 24 can be increased by shifting the fourth pressing portion 84 in the contact direction toward a position 84*a*. Conversely, the contact force of the first movable contact 23 can be decreased by shifting the third pressing portion 83 in the separation direction toward a position 83*b*. Similarly, the contact force of the second movable contact 24 can be decreased by shifting the fourth pressing portion 84 in the separation direction toward a position 84*b*.

The first pressing portion 81, the second pressing portion 82, and the fourth pressing portion 84 are provided on the first projection 73, the second projection 74, and the third projection 75, respectively. In this case, lengths of the first pressing portion 81, the second pressing portion 82, and the fourth pressing portion 84 are adjustable by changing lengths of the first projection 73, the second projection 74, and the third projection 75. More specifically, positions and sizes of the first contact portion 412, the second contact portion 413, and the fourth contact portions 423 are adjustable by changing the lengths of the first projection 73, the second projection 74, and the third projection 75. Accordingly, the contact parameters are easily adjustable.

The first pressing portion 81 is shorter than the third pressing portion 83. In this case, a long distance can be secured between the first contact portion 412 and the first movable contact 23. Accordingly, the separation force can be increased. Moreover, the third contact portion 422 is allowed to be positioned close to the first movable contact 23. Accordingly, contact stability between the first movable contact 23 and the first fixed contact 26 can be improved.

The contact piece 22 is disposed in the first recess 76 and the second recess 77. Accordingly, the link member 6 is attachable and detachable via the opening of the base 2 in a state of attachment between the contact piece unit 7 and the base 2. This configuration facilitates attachment and detachment of the link member 6 to the relay 1 and increases ease of assembly of the relay 1, compared with a configuration where the link member 6 is provided with a hole through which the contact piece 22 is inserted.

The link member 6 is disposed in the range of the width of the contact piece 22. The link member 6 is also located between the leading end 341 of the first divided piece 35 and the leading end 342 of the second divided piece 36 in the lengthwise direction. Accordingly, the size of the relay 1 can be reduced.

The present invention is not limited to the embodiment described herein as a specific embodiment of the present invention. Various modifications may be made without departing from the scope of the subject matters of the invention.

The configuration of the contact piece unit 7 may be modified from the configuration described above in the embodiment. For example, the shape of the contact piece 22 may be modified. The shapes or positions of the first to fourth contact portions 412, 413, 422, and 423 may be modified. The widths of the first divided piece 35 and the second divided piece 36 may be equalized. Alternatively, the width of the second divided piece 36 may be larger than the width of the first divided piece 35.

The shapes or positions of the movable contacts 23 and 24 may be modified. For example, the first movable contact 23 and the second movable contact 24 may be lined in the widthwise direction. Alternatively, the second movable contact 24 may be located on the leading end side of the first movable contact 23. The second movable contact 24 may be an open/close movable contact, while the first movable contact 23 may be an energization movable contact. In other words, an open/close movable contact may be attached to the second divided piece 36, while an energization movable contact may be attached to the first divided piece 35.

The configuration of the fixed contact unit 8 may be modified from the configuration described above in the embodiment. For example, the shapes or positions of the fixed contacts 26 and 27 may be modified in accordance with the foregoing modification of the contact piece unit 7.

Figure 20:
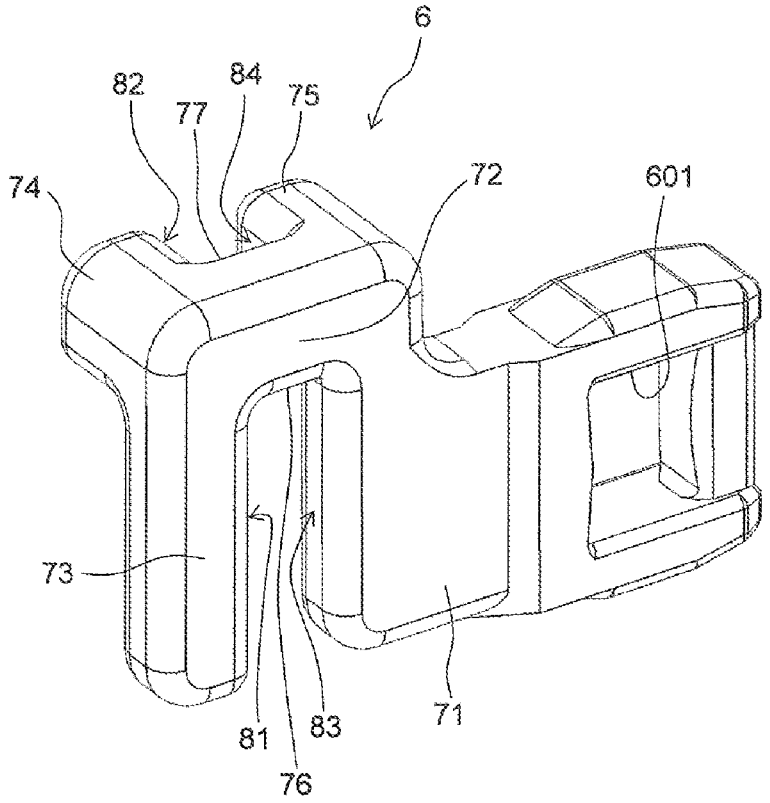
FIG. 20 is a view illustrating a link member according to a first modified example.
Figure 21:
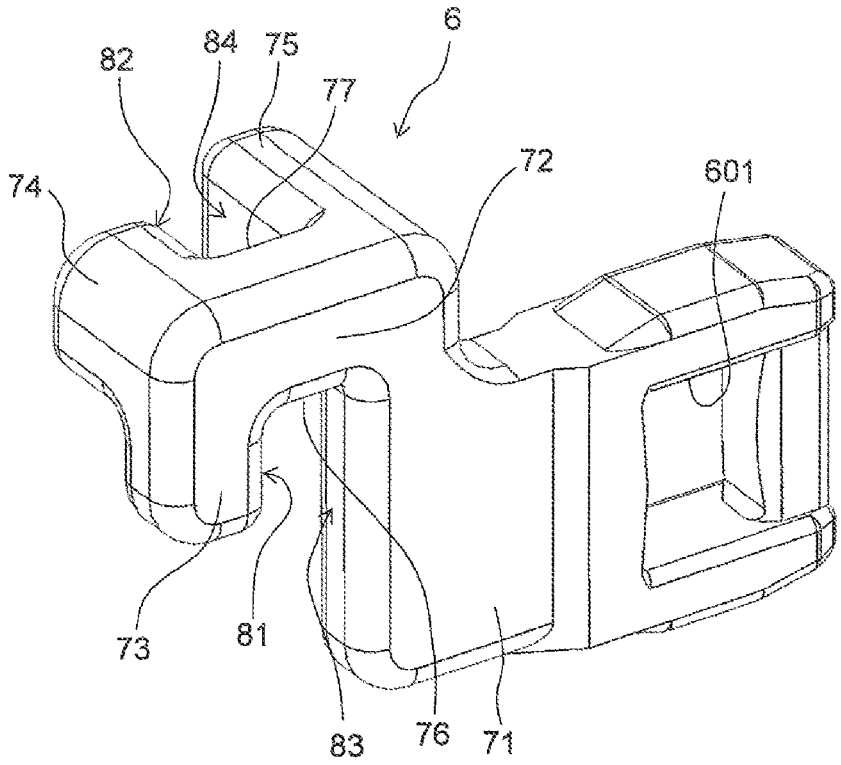
FIG. 21 is a view illustrating a link member according to a second modified example.

The shape of the link member 6 may be modified. For example, FIG. 20 is a view illustrating the link member 6 according to a first modified example. As illustrated in FIG. 20, the length of the first pressing portion 81 may be equal to the length of the third pressing portion 83. For example, FIG. 21 is a view illustrating the link member 6 according to a second modified example. As illustrated in FIG. 21, the length of the second pressing portion 82 may be different from the length of the fourth pressing portion 84.

The position of the first pressing portion 81 may deviate from the position of the second pressing portion 82 in the contact direction. Alternatively, the position of the first pressing portion 81 may deviate from the position of the second pressing portion 82 in the separation direction. The position of the third pressing portion 83 may deviate from the position of the fourth pressing portion 84 in the contact direction. Alternatively, the position of the third pressing portion 83 may deviate from the position of the fourth pressing portion 84 in the separation direction.

INDUSTRIAL APPLICABILITY

According to the present invention, contact parameters can be easily set for each contact of a plurality of movable contacts.

DESCRIPTION OF SYMBOLS

21 movable contact terminal
22 contact piece
35 first divided piece
36 second divided piece
23 first movable contact
24 second movable contact
25 fixed contact terminal
26 first fixed contact
27 second fixed contact
6 link member
81 first pressing portion

82 second pressing portion
83 third pressing portion
84 fourth pressing portion
412 first contact portion
413 second contact portion
422 third contact portion
423 fourth contact portion
72 junction
73 first projection
74 second projection
75 third projection
76 first recess
77 second recess

The invention claimed is:

1. A relay comprising:

a movable contact terminal;

a contact piece that is attached to the movable contact terminal, and comprises a first divided piece and a second divided piece extending in a lengthwise direction and divided from each other;

a first movable contact attached to the first divided piece;

a second movable contact attached to the second divided piece;

a fixed contact terminal disposed at a position facing the contact piece;

a first fixed contact attached to the fixed contact terminal, and disposed at a position facing the first movable contact;

a second fixed contact attached to the fixed contact terminal, and disposed at a position facing the second movable contact; and a link member capable of pressing the contact piece, wherein the link member comprises a first pressing portion configured to press the first divided piece, and extending in a widthwise direction of the contact piece, and a second pressing portion configured to press the second divided piece, and extending in the lengthwise direction a third pressing portion configured to press the first divided piece, and extending in the widthwise direction of the contact piece, and a fourth pressing portion configured to press the second divided piece, and extending in the lengthwise direction, the first pressing portion presses the first divided piece in a direction away from the fixed contact terminal, the second pressing portion presses the second divided piece in the direction away from the fixed contact terminal, the third pressing portion presses the first divided piece toward the fixed contact terminal, and the fourth pressing portion presses the second divided piece toward the fixed contact terminal.

2. The relay according to claim 1, wherein a length of the first pressing portion in the widthwise direction is different from a length of the third pressing portion in the widthwise direction.

3. The relay according to claim 2, wherein the first pressing portion is shorter than the third pressing portion in the widthwise direction.

4. The relay according to claim 1, wherein the first divided piece comprises a first contact portion pressed by the first pressing portion, and the first contact portion is disposed at a position away from the first movable contact in the widthwise direction.

5. The relay according to claim 4, wherein the first divided piece comprises a third contact portion pressed by the third pressing portion, and at least a part of the third contact portion is located closer to the first movable contact than the first contact portion in the widthwise direction.

6. The relay according to claim 5, wherein the second divided piece comprises a fourth contact portion pressed by the fourth pressing portion, and the third contact portion is located on a leading end side of the contact piece with respect to the fourth contact portion.

7. The relay according to claim 4, wherein a length of the second pressing portion in the lengthwise direction is different from a length of the fourth pressing portion in the lengthwise direction.

8. The relay according to claim 4, wherein the second divided piece comprises a second contact portion pressed by the second pressing portion, and the first contact portion is located on a leading end side of the contact piece with respect to the second contact portion.

9. The relay according to claim 1, wherein the link member further comprises a junction that extends from the third pressing portion in a direction toward the fixed contact terminal from the contact piece, and a first projection that projects in the widthwise direction from the junction, and the first pressing portion is provided on the first projection.

10. The relay according to claim 9, wherein the link member comprises a first recess formed by the junction, the first projection, and the third pressing portion, and a part of the first divided piece is disposed inside the first recess.

11. The relay according to claim 1, wherein the link member further comprises a second projection that projects in the lengthwise direction from the junction, and the second pressing portion is provided on the second projection.

12. The relay according to claim 11, wherein the link member further comprises a third projection that projects in the lengthwise direction from the junction, and the fourth pressing portion is provided on the third projection.

13. The relay according to claim 12, wherein the link member comprises a second recess formed by the junction, the second projection, and the third projection, and a part of the second divided piece is disposed inside the second recess.

14. The relay according to claim 1, wherein a leading end of the first divided piece is located on a leading end side of the contact piece with respect to a leading end of the second divided piece, and at least a part of the link member is located between the leading end of the first divided piece and the leading end of the second divided piece in the lengthwise direction.

15. The relay according to claim 1, wherein the link member is disposed in a range of a width of the contact piece.

16. The relay according to claim 1, wherein a width of the second divided piece is smaller than a width of the first divided piece, and the second divided piece includes a rib provided at a widthwise edge of the second divided piece and extending in the lengthwise direction.

* * * * *